US008336724B2

(12) United States Patent
Yamashita et al.

(10) Patent No.: US 8,336,724 B2
(45) Date of Patent: Dec. 25, 2012

(54) BEVERAGE CONTAINER

(75) Inventors: Daisuke Yamashita, Tokyo (JP); Yoshiyuki Oushi, Tokyo (JP)

(73) Assignee: Pigeon Corporation, Tokyo (JP)

( * ) Notice: Subject to any disclaimer, the term of this patent is extended or adjusted under 35 U.S.C. 154(b) by 645 days.

(21) Appl. No.: 12/306,184

(22) PCT Filed: Jun. 22, 2007

(86) PCT No.: PCT/JP2007/000674

§ 371 (c)(1),
(2), (4) Date: Jan. 22, 2009

(87) PCT Pub. No.: WO2007/148441

PCT Pub. Date: Dec. 27, 2007

(65) Prior Publication Data

US 2009/0255944 A1 Oct. 15, 2009

(30) Foreign Application Priority Data

Jun. 23, 2006 (JP) ..... 2006-174508

(51) Int. Cl.
*B65D 51/18* (2006.01)

(52) U.S. Cl. ..... 220/254.1; 220/709; 215/309

(58) Field of Classification Search ..... 220/705, 220/708, 254.9, 709, 254.1, 745, 748, 719; 454/254; 215/307, 308, 309
See application file for complete search history.

(56) References Cited

U.S. PATENT DOCUMENTS 5,273,172 A * 12/1993 Rossbach et al. ..... 215/229
6,523,711 B1 * 2/2003 Hughes et al. ..... 220/709
2002/0158069 A1 10/2002 Yoneoka et al.
2003/0168462 A1 9/2003 Kiyota
2005/0133505 A1 * 6/2005 Yoneoka et al. ..... 220/254.3

FOREIGN PATENT DOCUMENTS

JP 2001-39458 A 2/2001
JP 2002-321741 A 11/2002
(Continued)

OTHER PUBLICATIONS

Japanese Office Action for related Japanese Patent Application No. 2007-540447 dated Jul. 2, 2012.

(Continued)

*Primary Examiner* — Anthony Stashick
*Assistant Examiner* — Jeffrey Allen
(74) *Attorney, Agent, or Firm* — Kenealy Vaidya LLP

(57) ABSTRACT

A beverage container is configured to prevent a beverage from leaking out even when a user tilts the container, and to allow the user to easily drink the beverage even when pressure within the container is negative. The beverage container can include a container main body, a base member, and a cap body. The base member can have a vent for regulating a pressure variation in the container main body, and a ventilation valve for introducing air from the outside when the pressure within the container main body becomes negative in relation to the outside pressure and capable of preventing leakage of a liquid beverage contained in the container main body. The cap body can include a ventilation open/close hood capable of changing the state of the vent to a ventilation state or a closed state. The ventilation open/close hood can be configured to bring the vent into the closed state when in a portable state such as when the user carries the beverage container, and to bring the vent into the ventilation state when in an operating state.

19 Claims, 17 Drawing Sheets

FOREIGN PATENT DOCUMENTS

| | | | |
|---|---|---|---|
| JP | 2002-326655 | A | 11/2002 |
| JP | 3434503 | B2 | 5/2003 |
| JP | 2003-191971 | A | 7/2003 |
| JP | 2003-231545 | A | 8/2003 |
| JP | 2004-42982 | A | 2/2004 |
| JP | 2004-345742 | A | 12/2004 |
| JP | 2006-8187 | A | 1/2006 |
| JP | 2006-335464 | A | 12/2006 |
| JP | 2007-176537 | A | 7/2007 |

OTHER PUBLICATIONS

International Search Report for PCT/JP2007/000674 dated Aug. 21, 2007.

* cited by examiner (a)

(b)

(c)

BEVERAGE CONTAINER

TECHNICAL FIELD

This application is a national stage filing under 35 U.S.C. §371 of PCT Patent Application No. PCT/JP2007/000674, filed on Jun. 22, 2007, which claims the priority benefit under 35 U.S.C. §119 of Japanese Patent Application No. 2006-174508 filed on Jun. 23, 2006, which disclosure is hereby incorporated in its entirety by reference.

The present invention relates to a beverage container for containing a beverage such as milk.

BACKGROUND

A beverage container having a straw at a drinking spout has been used as a conventional beverage container from which an infant, for example, can drink milk, tea such as barley tea, juice and other kind of beverage. This type of beverage container has a cap so that it is portable, and another advantage thereof is that the infant can drink the beverage easily through the straw.

Such a beverage container is also so configured that the straw can be sealed so that the beverage within the container does not leak from the straw when a user carries it in a bag etc.

Moreover, when warm milk etc. is contained in this beverage container and the straw is sealed, positive pressure is generated within the container, and, as a result, the warm milk might squirt out of the straw when the infant actually opens the straw to drink the warm milk.

As described above, such a conventional beverage container has a ventilation hole formed therein to prevent milk etc. from squirting out of the straw.

This ventilation hole is opened and therefore needs to be covered so that the beverage does not leak out when carrying the beverage container. Therefore, the beverage containers described in, for example, Patent Document 1 and Patent Document 2 are proposed.

Specifically, the beverage container 1 of Patent Document 1 has an air hole control valve 6, while the beverage container 10 of Patent Document 2 has a lever 21 formed therein.

More specifically, when carrying these beverage containers, a user operates the air hole control valve 6 or the lever 21 to close a ventilation hole of the beverage container 1 etc. When drinking a beverage therein, the user operates the air hole control valve 6 etc. to open the ventilation hole so that warm milk etc. of the container is prevented from squirting out of the straw.

However, the problem of Patent Document 1 etc. is that the user has to operate the air hole control valve 6 by him/herself, which is a troublesome work. For this reason, other beverage containers are proposed by Patent Document 3 and Patent Document 4.

Specifically, there is described a mechanism for opening/closing a ventilation hole in synchronization with the opening/closing operation of a hood etc. that covers a straw and prevents a beverage from leaking out. More specifically, this beverage container is configured such that the ventilation hole is closed by covering the straw with the hood and the ventilation hole is opened by opening the hood.

Furthermore, Patent Document 5 discloses a mechanism in which a ventilation hole thereof is closed with a straw bent by a hood when carrying this beverage container, but the straw is recovered and thereby the ventilation hole is opened when drinking a beverage contained in this beverage container.

Patent Document 1: Japanese Patent Application Publication No. 2002-321741 (FIG. 1 etc.)

Patent Document 2: Japanese Patent Application No. 3434503 (FIG. 1 etc.)

Patent Document 3: Japanese Patent Application Publication No. 2004-42982 (FIG. 5 etc.)

Patent Document 4: Japanese Patent Application Publication No. 2004-345742

Patent Document 5: Japanese Patent Application Publication No. 2006-8187 (FIG. 1 etc.)

These portable beverage containers with straws fulfill the following demands. Specifically, Patent Document 1 to Patent Document 4 can fulfill the following demands.

In other words, (1) the straw and ventilation hole are sealed so that the beverage does not leak out when carrying the beverage container, (2) in the case of containing warm milk etc. as a beverage in the container, the ventilation hole is opened when a sealed state is changed to an opened state (when opening the container), so the milk etc. is prevented from squirting out of the straw, and (3) by bringing the ventilation hole into a closed state when drinking the beverage, the beverage does not leak out of the ventilation hole even when the beverage container is tilted or tossed.

However, the problem of Patent Document 1 to Patent Document 4 is that, although the beverage is prevented from leaking out when tilting the container to drink the beverage, the pressure within the container becomes negative as a user such as an infant drinks the beverage through the straw, making it gradually difficult for the user or infant to drink the beverage through the straw.

As to Patent Document 5, on the other hand, although the advantage thereof is that the pressure within the container does not become negative when the user drinks the beverage therefrom because the ventilation hole is opened when drinking, the problem is that the beverage leaks out of the ventilation hole when the container is tilted.

DISCLOSURE OF THE INVENTION

Therefore, an object of the present invention is to provide a beverage container that is capable of preventing a beverage contained in a container main body from leaking out even when a user tilts it to drink the beverage through a drinking spout part such as a straw, and preventing the container main body from generating negative pressure, to allow the user to drink the beverage easily.

According to an invention of claim 1, the above object can be achieved by a beverage container, which has: a container main body having a container opening part for pouring a liquid beverage therein; a base member which covers the container opening part and in which a drinking spout is disposed; and a cap body for openably/closably covering an upper part of the base member, wherein the base member has first ventilation means for regulating a pressure variation in the container main body, and second ventilation means for introducing air from outside when the pressure within the container main body enters a negative pressure state in relation to outside pressure, and preventing the liquid beverage contained in the container main body from leaking, the cap body has formed thereon ventilation open/close means capable of changing the state of the first ventilation means to a ventilation state or a closed state, the ventilation open/close means brings the first ventilation means into the closed state in the case of a portable state in which the cap body is disposed to cover the drinking spout so that a user can carry the beverage container and a drinking state in which the cap body is disposed to expose the drinking spout so that the user can use the drinking spout, and brings the first ventilation means into the ventilation state in the case of an operating state in which the cap body is disposed in an intermediate position between the portable state and the drinking state.

According to the above configuration, the base member has the first ventilation means for regulating a pressure variation in the container main body, and the second ventilation means for introducing air from outside when the pressure within the container main body becomes negative in relation to outside pressure, and preventing the liquid beverage within the container main body from leaking. Moreover, according to the above configuration, the cap body has formed thereon the ventilation open/close means capable of changing the state of the first ventilation means to a ventilation state or a closed state, wherein the ventilation open/close means brings the first ventilation means into the closed state in the case of a portable state in which the cap body covers the drinking spout so that a user can carry the beverage container and a drinking state in which the cap body is disposed to expose the drinking spout so that the user can use the drinking spout, and brings the first ventilation means into the ventilation state in the case of an operating state in which the cap body is disposed in an intermediate position between the portable state and the drinking state.

Therefore, in the portable state the ventilation open/close means brings the first ventilation means of the beverage container into the closed state so that the liquid beverage contained in the container main body does not leak out of the first ventilation means. In addition, the liquid beverage is prevented from leaking out of the second ventilation means.

The first ventilation means is in the ventilation state when the cap body is disposed in the operating state at the intermediate position between the portable state and the drinking state. For this reason, even when warm milk etc. is contained in the container main body and, therefore, the pressure within the container becomes positive pressure in relation to the outside pressure, this pressure is regulated to atmospheric pressure by means of the first ventilation means. Therefore, the milk etc. can be prevented from squirting out of the drinking spout.

Because disposing the cap body in the drinking state brings the first ventilation means into the closed state, the liquid beverage inside the container does not leak out of the first ventilation means even when the user tilts the container main body to drink the liquid beverage therein through the drinking spout.

Furthermore, the base member has the second ventilation means even when the cap body is in the drinking state and the first ventilation means in the closed state.

Therefore, even when the user drinks the liquid beverage of the container main body through the drinking spout and, as a result, the content is reduced and the pressure within the container main body becomes negative, external air is introduced from the second ventilation means into the container main body, thereby promptly eliminating the negative pressure state. Consequently, the pressure within the container main body becomes negative, allowing the user to drink the beverage through the drinking spout easily and therefore making the beverage container handy.

As described above, the above configuration can provide a beverage container that is capable of (1) preventing the beverage contained in the container main body from leaking out when carrying the beverage container, (2) preventing a liquid beverage such as warm milk from squirting out of the drinking spout even when such beverage is contained, (3) preventing the liquid beverage contained in the container main body from leaking out even when the container main body is tilted at the time of drinking, and (4) allowing the user to drink the liquid beverage easily even when the pressure within the container main body becomes negative.

According to invention of claim 2 is the beverage container, in the configuration of claim 1, preferably, the ventilation open/close means brings the second ventilation means into the closed state when the cap body is disposed in the portable state.

According to the above configuration, the ventilation open/close means the ventilation open/close means brings the second ventilation means into the closed state when the cap body is disposed in the portable state. Therefore, because the liquid beverage contained in the container main body can be prevented from leaking out of the second ventilation means, the liquid beverage of the main container can be securely prevented from leaking when carrying the beverage container.

According to an invention of claim 3, in the configuration of claim 1 or claim 2, preferably, the first ventilation means is a ventilation hole in the form of a through-hole, the second ventilation means is a ventilation valve in the form of a check valve for allowing air to flow only into the container main body, the ventilation hole and the ventilation valve are formed as an integrated ventilation member, and thus obtained ventilation member is disposed on the base member.

According to the above configuration, the ventilation hole and the ventilation valve are formed as the integrated ventilation member, and this ventilation member is disposed on the base member. Therefore, not only is it possible to obtain a simple configuration by positioning the opened ventilation hole and the ventilation valve in a single member, but also it is possible to thereby reduce the number of parts to seal the ventilation holes securely. Consequently, for example, even when the ventilation member is formed independently, the ventilation member can be assembled easily and securely. As a result, it is possible to significantly reduce the problems associated with leakage of the liquid beverage from the base member that is caused by inadequate assembly of the ventilation hole and ventilation valve. Also, even when the ventilation hole and the ventilation valve are integrally molded with the base member, the liquid beverage leaks from a limited position, so the beverage container can be sealed securely.

When the ventilation hole and the ventilation valve need to be removed for cleaning etc, they can be detached as one unit, making the beverage container very handy for the user.

According to an invention of claim 4, in the configuration of any one of claim 1 to claim 3, preferably, the ventilation open/close means has formed therein: a portable sealing part for bringing the first ventilation means and the second ventilation means into the closed state when the cap body is in the portable state; a drinking sealing part for bringing the first ventilation means into the closed state and the second ventilation means into the ventilation state when the cap body is in the drinking state; and an air circulating part for bringing the first ventilation means into the ventilation state when the cap body is in the operating state.

According to the above configuration, the ventilation open/close means has formed therein: a portable sealing part for bringing the first ventilation means and the second ventilation means into the closed state when the cap body is in the portable state; a drinking sealing part for bringing the first ventilation means into the closed state and the second ventilation means into the ventilation state when the cap body is in the drinking state; and an air circulating part for bringing the first ventilation means into the ventilation state when the cap body is in the operating state.

Therefore, operating the cap body can bring the first ventilation means and the second ventilation means into the closed sealed state when the cap body is in the portable state. Operating the cap body can also bring the first ventilation means into the closed state to prevent leakage of the liquid when the cap body is in the drinking state, and bring the second ventilation means into the ventilation state to appropriately allow external air to flow-in. Furthermore, operating the cap body can bring the first ventilation means into the ventilation state to release increased internal pressure when the cap body is in the operating state. As a result, because the configuration can be made simple, not only is it possible to reduce the production cost but also it is possible to provide a beverage container having excellent operability and capable of reliably exerting its function.

According to an invention of claim 5, in the configuration of any one of claim 1 to claim 4, preferably, the cap body can house or expose the drinking spout disposed in the base member, by changing the position of the cap body relative to the base member.

According to the above configuration, the cap body can house or expose the drinking spout disposed in the base member by changing the position of the cap body relative to the base member. As a result, not only is it possible to obtain a beverage container from which the beverage does not leak and the user can drink the beverage easily by simply moving the cap body, but also the drinking spout can be housed in the cap body or exposed by moving the cap body. Therefore, the beverage container handy for the user can be obtained.

According to an invention of claim 6, in the configuration of any one of claim 1 to claim 5, preferably, the cap body has a hood member for housing or exposing the drinking spout, regulating means for regulating a movement of the hood member, and the ventilation open/close means is formed in the regulating means.

According to the above configuration, the cap body has a hood member for housing or exposing the drinking spout, and regulating means for regulating a movement of the hood member, wherein the regulating means has the ventilation open/close means.

Therefore, the ventilation open/close means can be operated without performing an operation for exposing the drinking spout. In other words, only the ventilation open/close means can be operated without moving the hood member, so that the hood member can be prevented from being accidentally opened.

According to an invention of claim 7, in the configuration of claim 1 or claim 2, preferably, the first ventilation means is a ventilation hole in the form of a through-hole, and the second ventilation means introduces the air from the outside when the negative pressure within the container main body increases to a negative pressure state resulting from a drinking action of the user.

According to the above configuration, because the second ventilation means introduces air from the outside when the negative pressure within the container main body increases to the negative pressure state generated as a result of a drinking action of the user, the liquid beverage contained in the container main body can be prevented from leaking from the drinking spout, even when the user accidentally tosses the container main body when the cap body is disposed in the drinking state to expose the drinking spout.

Specifically, in a situation where the liquid beverage leaks from the drinking spout by tossing the container main body in the drinking state, the pressure within the container main body becomes slightly negative. When the second ventilation means introduces air from the outside in such a state, the liquid beverage of the container main body leaks from the drinking spout.

In this regard, because the second ventilation means of the above configuration does not introduce air from the outside when the pressure is slightly negative, the liquid beverage of the container main body does not leak from the drinking spout even when the user accidentally tosses the container main body.

On the other hand, when the user drinks the beverage container from the container main body by placing the drinking spout in the mouth and suctioning it, the negative pressure within the container main body generated by this drinking action becomes higher than the negative pressure generated when the container main body is tossed as described above. In such a state, as a result, the second ventilation means introduces air from the outside.

Therefore, when the user drinks the liquid beverage contained in the container main body, the negative pressure state of the container main body is eliminated by the second ventilation means, whereby the user can drink the liquid beverage smoothly.

According to an invention of claim 8, in the configuration of claim 7, preferably, the second ventilation means has a ventilation opening part for introducing the air from the outside, and a ventilation closing part capable of bringing the ventilation opening part into a closed state. When the negative pressure within the container main body increases to the negative pressure state as a result of the drinking action of the user, the ventilation closing part releases the closed state of the ventilation opening part to introduce the air from the outside.

According to the above configuration, the second ventilation means has a ventilation opening part for introducing the air from the outside, and a ventilation closing part capable of bringing the ventilation opening part into the closed state. When the negative pressure within the container main body increases to the negative pressure state as a result of the drinking action of the user, the ventilation closing part releases the closed state of the ventilation opening part and consequently the second ventilation means introduces the air from the outside.

Therefore, even when the user tosses the container main body and, as a result, the pressure within the container main body enters the negative pressure state, the ventilation closing part brings the ventilation opening part into the closed state so that the liquid beverage contained in the container main body does not leak from the drinking spout.

On the other hand, when the pressure within the container main body increases to the negative pressure state as a result of the drinking action of the user, the ventilation closing part releases the closed state of the ventilation opening part to introduce the air into the container, thereby releasing the negative pressure state within the container.

Therefore, because the negative pressure state within the container main body is released by the second ventilation means, the user can drink the liquid beverage smoothly.

According to an invention of claim 9, in the configuration of any one of claims 1 to 8, preferably, the drinking spout has formed thereon an open/close valve capable of preventing leakage of the liquid beverage contained in the container main body and of flowing the liquid beverage out by means of deformation of the drinking spout.

According to the above configuration, the drinking spout has formed thereon an open/close valve capable of preventing leakage of the liquid beverage contained in the container main body and of flowing the liquid beverage out by deforming the drinking spout.

Therefore, even when the user accidentally tosses the container main body, the liquid beverage within the container main body is blocked by the open/close valve so that it does not leak out.

On the other hand, when the user places the drinking spout in the mouth and deforms the drinking spout, the open/close valve enters an opened state, and consequently the liquid beverage contained in the container main body flows out and is supplied into the mouth of the user without being blocked.

According to an invention of claim 10, in the configuration of claim 9, preferably, the open/close valve is a shielding part for blocking the liquid beverage contained in the drinking spout and a cutout part that is formed in the shielding part in a deformable manner.

According to the above configuration, the open/close valve is a shielding part for blocking the liquid beverage within the drinking spout and a cutout part that is formed in the shielding part in a deformable manner.

Therefore, even when the user tosses the container main body, the liquid beverage within the container main body is blocked by the shielding part so it does not leak out.

On the other hand, when the user places the drinking spout in the mouth and deforms the drinking spout, the cutout part is deformed and opened and the liquid beverage contained in the container main body flows out and is supplied into the mouth of the user without being blocked.

An advantage of the present invention is to provide a beverage container that is capable of preventing a beverage contained in a container main body from leaking out even when a user tilts it to drink the beverage through a drinking spout part such as a straw, and preventing the container main body from generating negative pressure, to allow the user to drink the beverage easily.

BRIEF DESCRIPTION OF THE DRAWINGS

FIG. 3(*b*) is a schematic plan view in which the ventilation member of FIG. 3(*a*) is viewed from above;

FIG. 3(*c*) is a schematic cross-sectional diagram of the ventilation member of FIG. 3(*b*);

FIG. 11(*b*) is a schematic end view taken along the line B-B' of FIG. 11(*a*);

FIG. 11(*c*) is a schematic end view taken along the line C-C' of FIG. 11(*a*);

FIG. 11(*d*) is a schematic end view showing the relationship between a rotation axis and a ventilation member, the relationship being obtained when the hood shown in FIG. 10 is disposed in the abovementioned operating state;

FIG. 11(*e*) is a schematic end view taken along the line B-B' of FIG. 11(*d*);

FIG. 11(*f*) is a schematic end view taken along the line C-C' of FIG. 11(*d*);

FIG. 11(*g*) is a schematic end view showing the relationship between the rotation axis and the ventilation member, the relationship being obtained when the hood shown in FIG. 10 is disposed in a drinking state;

FIG. 11(*h*) is a schematic end view taken along the line B-B' of FIG. 11(*g*);

FIG. 11(*i*) is a schematic end view taken along the line C-C' of FIG. 11(*g*);

FIG. 15(*b*) is a schematic cross-sectional diagram showing a state in which the closing member allows air to pass through the ventilation opening part;

Figure 1:
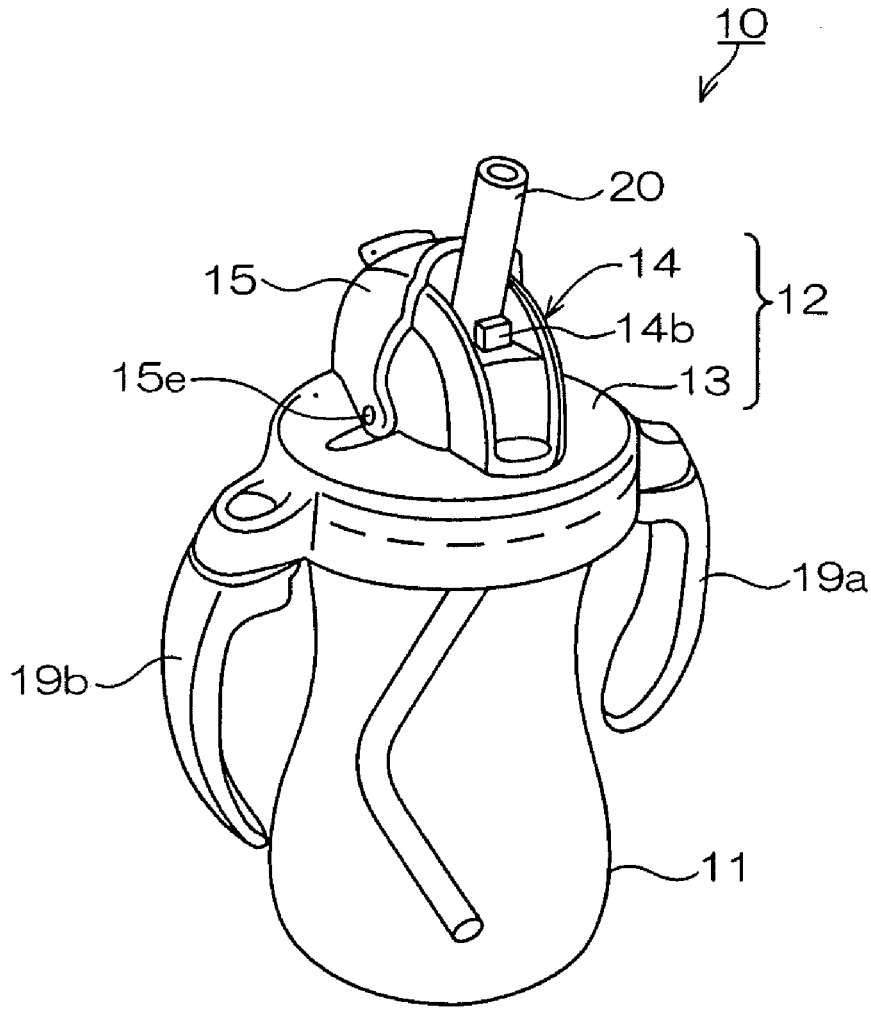
FIG. 1 is a schematic diagram showing a beverage container according to a first embodiment of the present invention.

10 Beverage container
11 Container main body
12 Base member
15 Hood
15*a* Drinking sealing convex part
15*b* Portable sealing convex part
15*c* Air circulating part
20, 210, 220 Straw
17, 117 Ventilation valve
117*b* Ventilation opening
117*c* Closing member
117*a* Closing convex part
211 Open/close valve
211*a* Shielding part
211*b* Slit

BEST MODE FOR CARRYING OUT THE INVENTION

Preferred embodiments of the present invention are described hereinafter in detail with reference to the attached drawings.

Because the following embodiments are preferred concrete examples of the present invention, a variety of technically preferable restrictions are imposed on these embodiments, but the scope of the present invention is not limited to these embodiments unless otherwise specifically noted as such in the following description.

(First Embodiment)

(The Entire Configuration Etc. of a Beverage Container 10)

FIG. 1 is a schematic diagram of the beverage container 10 according to a first embodiment of the present invention and shows a drinking state. As shown in FIG. 1, the beverage container 10 has a clear container main body 11 for containing a liquid beverage, such as warm milk.

A base member 12 is disposed in the upper part of the container main body 11, and a straw 20, a drinking spout, is disposed in the base member 12. As shown in FIG. 1, the base member 12 has a base bottom part 13 that is disposed such as to cover the container main body 11, and a base upright part 14 that is formed such as to protrude above from the base bottom part 13.

The base member 12 also has a hood 15 which is a cap body for covering the upper part of the base upright part 14 openably.

As shown in FIG. 1, two handles 19*a*, 19*b* are disposed on each side of the base member 12 along the container main body 11.

Figure 2:
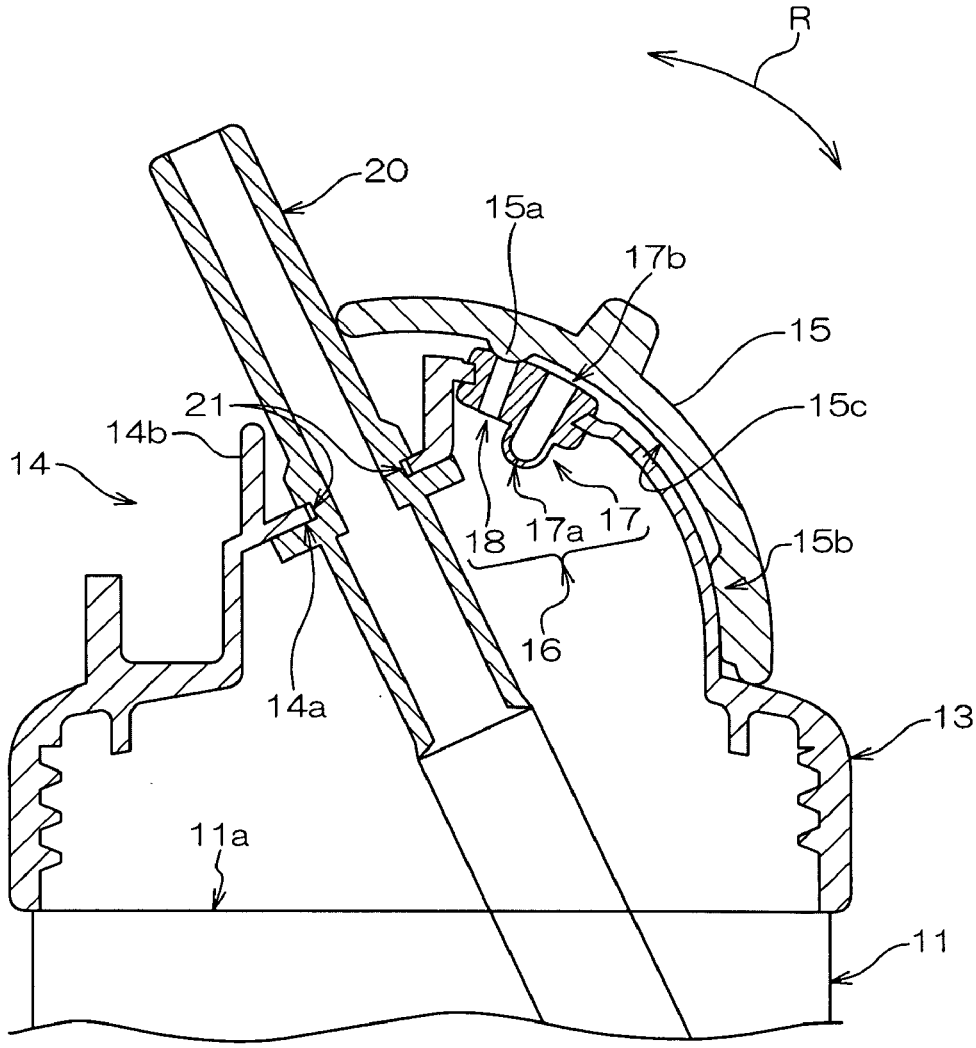
FIG. 2 is a schematic end view of the beverage container of FIG. 1.

FIG. 2 is a schematic end view of the beverage container 10 of FIG. 1. As shown in FIG. 2, the upper part of the container main body 11 has formed thereon a container opening 11*a*, which is a container opening part opened widely for pouring the abovementioned warm milk and cleaning the container main body 11.

Also, as shown in FIG. 2, the base bottom part 13 is disposed such as to cover the container opening 11*a* and is made detachable with respect to the container opening 11*a* by providing a screw part to be screwed on an inner surface.

Moreover, as shown in FIG. 2, the base upright part 14 has formed thereon a straw hole 14*a*, which is a through-hole for disposing the straw 20 communicated with a container straw of a different material disposed therebelow. Because this straw hole 14*a* is formed in accordance with the outer shape of the straw 20, the straw 20 closes the straw hole 14*a* by disposing the straw 20 on the straw hole 14*a*, so that the milk contained in the container main body 11 does not leak out.

Specifically, a ring-like fitting concave part 21 is formed on the straw 20 as shown in FIG. 2, so that when the straw 20 is inserted thereto from the container main body 11 side the ring-like fitting concave part 21 is fitted to the straw hole 14*a*, whereby the straw 20 is fixed.

Because the lower side of the straw 20 is disposed in the container main body 11 as shown in FIG. 1 and FIG. 2, a user can drink the milk contained in the container main body 11 by holding an upper end of the straw 20 in the mouth and suctioning it.

Figure 3:
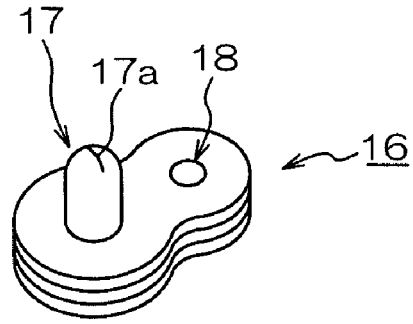
FIG. 3(*a*) is a schematic perspective diagram showing a ventilation member of FIG. 2.
Figure 3:
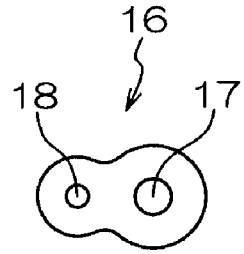
Figure 3:
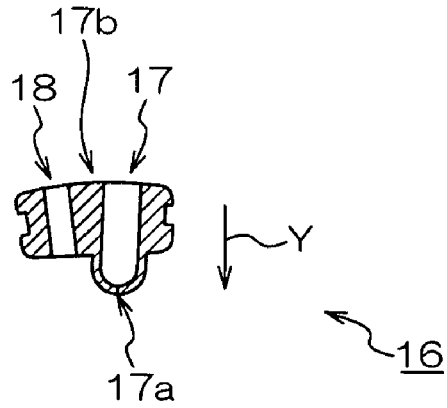

Furthermore, a ventilation member 16 made of an elastic body such as silicone or elastomer is disposed in the base upright part 14, as shown in FIG. 2. FIG. 3(*a*) is a schematic perspective diagram in which the ventilation member 16 of FIG. 2 is viewed from the container main body 11 side shown in FIG. 2, FIG. 3(*b*) a schematic plan view in which the ventilation member 16 in FIG. 3(*a*) is viewed from the upper side of FIG. 2, and FIG. 3(*c*) a schematic cross-sectional diagram of the ventilation member 16 of FIG. 3(*b*).

As shown in FIG. 3(*c*), the ventilation member 16 has a ventilation hole 18, which is a through-hole, and a ventilation valve 17. The ventilation valve 17 has a slit 17*a* shown in FIG. 2, FIG. 3(*a*) and FIG. 3(*c*), and its entirety forms a check valve. Specifically, because the slit 17*a*, made of a flexible material, is formed on a leading end of a hollow part that projects in one direction, the valve is opened only when air flows in the direction of the arrow Y shown in FIG. 3(*c*) and the valve is closed when the air or liquid flows in the opposite direction.

In other words, when applying this configuration in FIG. 2, the air (gaseous matter) flows from the outside the beverage container 10 into the beverage container 10.

As described above, the ventilation hole 18 and the ventilation valve 17 are integrally formed in the ventilation member 16, and this ventilation member 16 is mounted in the base upright part 14 as shown in FIG. 2.

Note in the present embodiment that the ventilation member 16 is formed separately from the base member 12, but the base member 16 may be integrally molded with the base member 12. In this case, the ventilation member 16 can be integrally molded by means of two-color molding or insert molding.

Incidentally, the beverage container 10 of the present embodiment is configured as a portable beverage container 10 such that, because it has the straw 20, the milk does not leak from a leading end of the straw 20.

Figure 4:
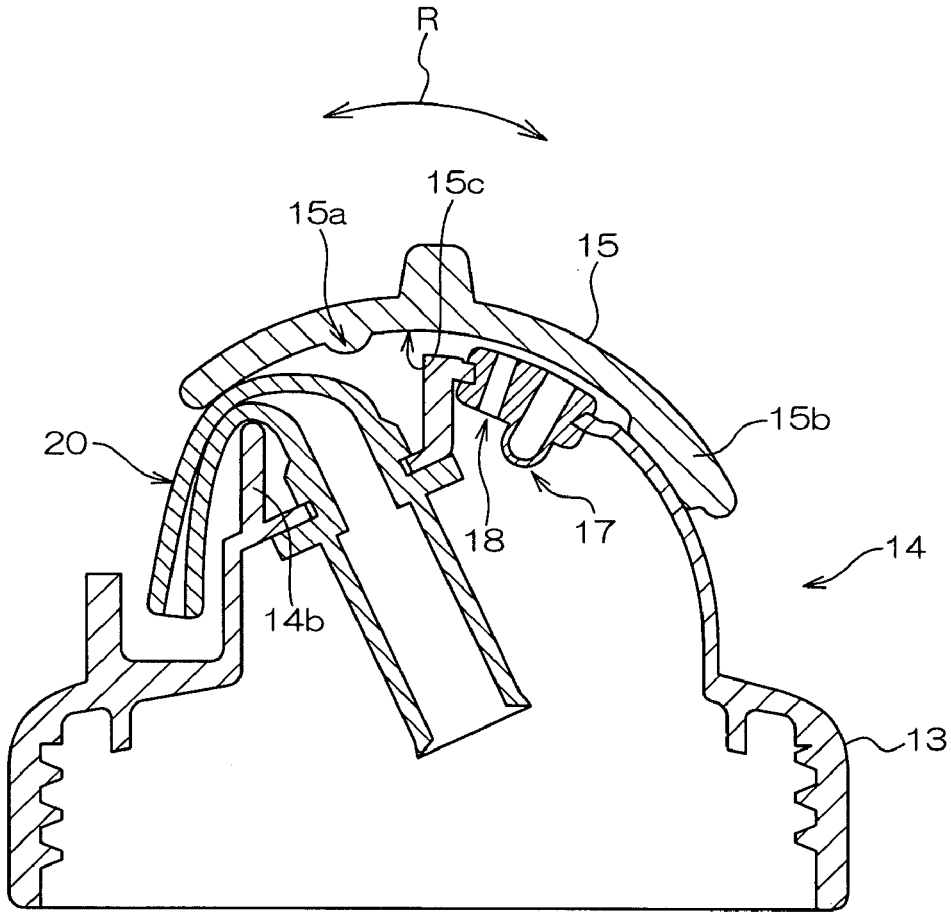
FIG. 4 is a schematic end view showing a state in which a hood of FIG. 2 is moved.
Figure 5:
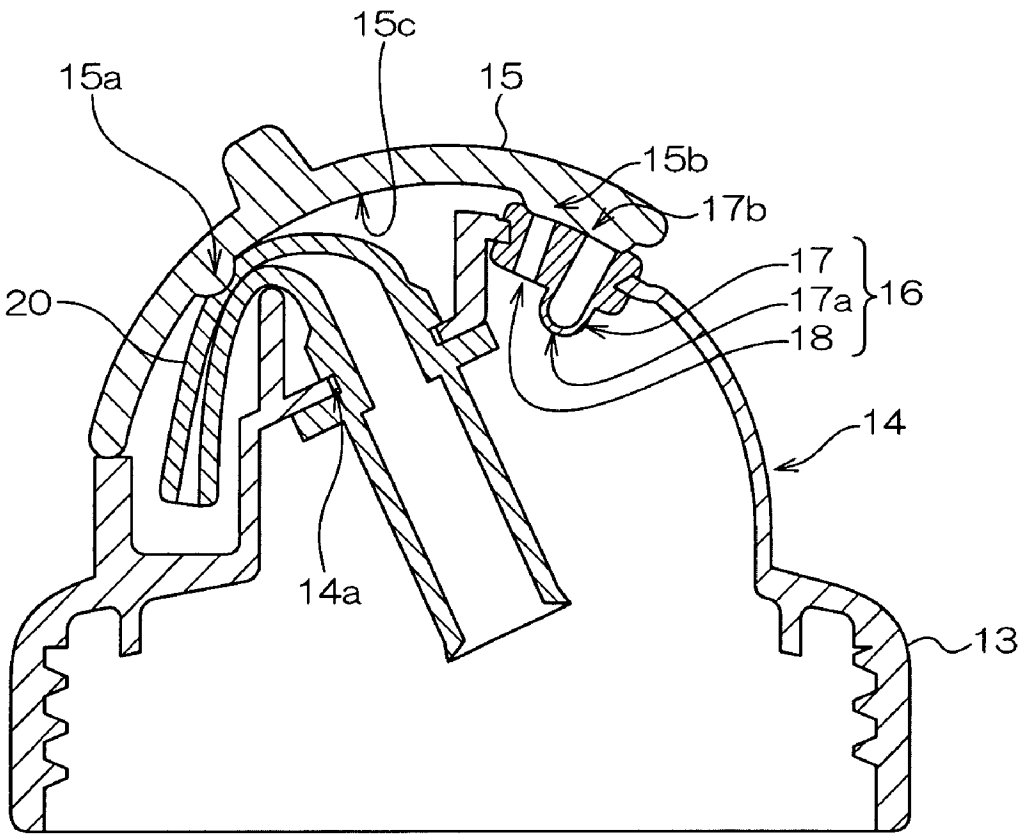
FIG. 5 is another schematic end view showing a state in which the hood of FIG. 2 is moved.

FIG. 4 and FIG. 5 are schematic end views each showing a state in which the hood 15 shown in FIG. 2 is moved, FIG. 4 showing an operating state and FIG. 5 a portable state.

As shown in FIG. 2, FIG. 4 and FIG. 5, the hood 15 can move around an axis point 15*e* (see FIG. 1) along the base upright part 14 in the direction of the arrow R shown in FIG. 2 etc. In the base upright part 14, as shown in FIG. 1 and FIG. 2, a straw sealing convex part 14*b* is formed such as to project toward the straw 20. Therefore, as shown in FIG. 4 and FIG. 5, when the hood 15 moves, the straw 20 is held between an inner surface of the hood 15 and the straw sealing convex part 14*b* so that the opening is closed.

In this manner, the milk contained in the container main body 11 can be prevented from leaking from the leading end of the straw 20 when carrying the beverage container 10.

Also, as shown in FIG. 5, when the hood 15 enters the portable state where the opening is closed, the straw 20 is completely housed in the space formed by the base upright part 14 and hood 15.

As described above, in the present embodiment the hood 15 can house the straw 20 inside the abovementioned space or expose the straw 20 by changing the position of the base upright part 14 relative to the hood 15.

Incidentally, the ventilation hole 18 is formed on the base upright part 14 as shown in FIG. 2. The function of the ventilation hole 18 is now described.

For example, the user such as a mother uses the hood 15 to bring the straw 20 into the closed state in order to carry or stir the beverage container 10 containing the warm milk. Without the ventilation hole 18, the pressure within the container main body 11 increases and becomes positive pressure in relation to the outside pressure.

When the hood 15 is moved to the drinking state shown in FIG. 2 and the straw 20 is extracted in order for the user to drink the milk, the warm milk might squirt out of the leading end of the straw 20 due to the high pressure within the container main body 11.

For this reason, in the present embodiment the ventilation hole 18 is formed in order to reduce the positive pressure of the container main body 11 to the atmospheric pressure in conjunction with the movement of the hood 15 or straw 20, whereby the milk is prevented from squirting out of the straw 20.

Therefore, the ventilation hole 18 is an example of the first ventilation means for regulating a pressure variation in the container main body 11.

On the other hand, as the ventilation hole 18 is a through-hole, when the ventilation hole 18 is constantly opened, tilting the beverage container 10 causes leakage of the milk of the container main body 11 from the ventilation hole 18. Also, the milk might leak out of the ventilation hole 18 when the user assisting an infant etc. in drinking the milk largely tilts or tosses the beverage container 10 to drink the milk through the straw 20.

For this reason, the present embodiment adopts the following configurations. Specifically, as shown in FIG. 2 etc, on the inside of the hood 15, there are formed a convex drinking sealing convex part 15*a* provided adjacent to the straw 20 and a convex portable sealing convex part 15*b* provided apart from the straw 20. These convex parts come into abutment against the elastic ventilation member 16 so that the ventilation hole 18 and/or ventilation valve 17 of the ventilation member 16 can be sealed. Moreover, an air circulating part 15*c* that is not in abutment against the ventilation hole 18 is formed between the sealing convex parts 15*a*, 15*b*.

Hereinafter, the functions of the drinking sealing convex part 15*a*, the air circulating part 15*c* and the portable sealing convex part 15*b* in relation to the ventilation hole 18 are described specifically.

First of all, in the portable state of the beverage container 10 in which the hood 15 is disposed to cover the straw 20 as shown in FIG. 5, the beverage container 10 is often tilted or inverted, as it bounces in, for example, a bag or the like. For this reason, the opening of the straw 20 is in the closed state as described above, and the ventilation hole 18 is also brought into the closed state by the portable sealing convex part 15*b*. Therefore, the milk contained in the container main body 11 can be prevented from leaking from the ventilation hole 18 during the portable state.

Next, the user attempting to open the hood 15 starts moving the hood 15 to bring it into the drinking state shown in FIG. 2, and then obtains the operating state shown in FIG. 4. Because the hood 15 maintains the opening of the straw 20 closed in this operating state, the milk does not leak from the straw 20 even when the pressure within the container main body 11 is positive.

In this operating state, however, the portable sealing convex part 15*b* separates from the ventilation hole 18 to open the ventilation hole 18, as shown in FIG. 4. The ventilation hole 18 is then disposed to face the space in the air circulating part 15*c*.

In this manner, the air can be discharged through this ventilation hole 18 and the air circulating part 15*c* so that the pressure can be regulated, even when the pressure within the container main body 11 becomes positive due to the warm milk inside the container main body 11. As a result, the pressure within the container main body 11 can be reduced to the atmospheric pressure.

When the user continues to move the hood 15 to bring it into the opened drinking state, the state in which the hood 15 bends the straw 20 to close the opening of the straw 20 as shown in FIG. 4 becomes the state in which the straw 20 is released and recovered as shown in FIG. 2, that is, the state in which the opening of the straw 20 enters a release state.

Furthermore, in the drinking state shown in FIG. 2 (the state in which the user can drink the milk within the container main body 11 through the straw 20), the drinking sealing convex part 15*a* of the hood 15 comes into abutment against the ventilation hole 18 to bring the ventilation hole 18 into the closed state, so that the liquid does not leak from both the ventilation hole 18 and the straw 20 when the user tilts or tosses the beverage container, because the opening of the container main body 11 is confined to the straw 20.

As described above, in the present embodiment the hood 15 has formed therein the drinking sealing convex part 15*a*, portable sealing convex part 15*b* and air circulating part 15*c* (an example of the ventilation open/close means) that are capable of changing the state of the ventilation hole 18 to the ventilation state or the closed state. The drinking sealing convex part 15*a*, portable sealing convex part 15*b* and air circulating part 15*c* bring the ventilation hole 18 into the closed state by bringing the drinking sealing convex part 15*a* and portable sealing convex part 15*b* into abutment against the ventilation hole 18 during the portable state (the state shown in FIG. 5 in which the hood 15 is disposed to cover the base upright part 14 and the straw 20 so that the user can carry the beverage container 10) and the drinking state (the state shown in FIG. 2 in which the hood 15 is disposed to expose the base upright part 14 and the straw 20 so that the user can use the straw 20).

In addition, in the operating state (the state shown in FIG. 4 in which the hood 15 is disposed in the intermediate position between the portable state and the drinking state), the air circulating part 15*c* is disposed without bringing the drinking sealing convex part 15*a* and portable sealing convex part 15*b* into abutment against the ventilation hole 18, whereby the ventilation hole 18 is brought into the ventilation state.

Because the ventilation valve 17 shown in FIG. 2 has the slit 17*a* and is configured to introduce the air from the outside as shown by the arrow Y in FIG. 3(*c*) when the pressure within the container main body 11 becomes negative, the milk contained in the container main body 11 can be prevented from leaking through the ventilation valve 17. The ventilation valve 17 is an example of the second ventilation means.

As shown in FIG. 5, in portable state in which the hood 15 is the shut-off and sealed, the portable sealing convex part 15*b* comes into abutment against an opening surface 17*b* on the opposite side of the slit 17*a* of the ventilation valve 17, whereby the ventilation hole 18 is brought into the sealed state. On the other hand, in the state in which the user starts opening the hood 15 to drink the milk (FIG. 4) and the state in which the hood 15 is completely opened (FIG. 2), the air circulating part 15*c* is disposed on the opening surface 17*b* and the opening surface 17*b* is released, to allow the external air to flow in accordance with the pressure variation in the container main body 11.

The present embodiment can achieve the following operational effects due to the above-described configurations.

Specifically, because the ventilation hole 18 of the beverage container 10 is brought into the closed state by the portable sealing convex part 15*b* in the portable state shown in FIG. 5, the milk housed in the container main body 11 does not leak from the ventilation hole 18. The milk also does not leak from the ventilation valve 17 serving as a check valve.

Particularly, in the present embodiment, when the hood 15 is disposed in the portable state shown in FIG. 5, the portable sealing convex part 15*b* comes into abutment against the ventilation hole 18 and ventilation valve 17 to obtain the closed state in which the straw 20 is covered.

As a check valve, the ventilation valve 17 is normally structured to prevent leakage of the milk. However, it is considered that a strong force acts on a direction in which the milk leaks out with respect to the ventilation valve 17 and thereby the milk accidentally leaks out. It is considered that the beverage container 10 might be disposed the other way around especially in the portable state. In the present embodiment, therefore, the portable sealing convex part 15*b* closes the ventilation valve 17 to securely prevent leakage of the milk.

Moreover, in the present embodiment, the ventilation hole 18 is in the ventilation state when the hood 15 is disposed in the operating state, which is the intermediate position between the portable state and the drinking state (the position shown in FIG. 4). For this reason, even when the pressure within the container main body 11 becomes positive pressure in relation to the outside pressure due to the warm milk housed in the container main body 11, the pressure is regulated to the atmospheric pressure via the ventilation hole 18 so that the warm milk contained in the container main body 11 can be prevented from squirting out of the straw 20.

Moreover, because the ventilation hole 18 enters the closed state by disposing the hood 15 to the drinking state shown in FIG. 2, the milk contained in the container main body 11 does not leak out from the ventilation hole 18 or the straw 20 even when the user largely tilts the container main body 11 to drink the milk through the straw 20 or tosses the beverage container 10.

Furthermore, the ventilation valve 17 is formed on the base upright part 14 even when the hood 15 is in the drinking state and the ventilation hole 18 in the closed state. At this moment, the ventilation valve 17 is not closed by the drinking sealing convex part 15*a* as shown in FIG. 2, but is disposed to face the air circulating part 15*c* so that the ventilation state is obtained.

Therefore, even when the user drinks the milk contained in the container main body 11 through the straw 20 and, as a result, the content is reduced and the pressure within the container main body 11 becomes negative, the slit 17*a* of the ventilation valve 17 is opened and the external air is introduced into the container main body 11, thereby promptly eliminating the negative pressure state.

Consequently, the pressure within the container main body 11 becomes negative, allowing the user to drink the milk through the straw 20 easily and therefore making the beverage container 10 handy.

In addition, because the ventilation valve 17 functions as a check valve, the milk does not leak even when the container main body 11 is tilted to the extent that the drinking state is obtained.

The present embodiment described above provides the excellent beverage container 10 that is capable of (1) preventing the milk contained in the container main body 11 from leaking out when carrying the beverage container 10, (2) preventing the warm milk from squirting out of the straw 20 even when the milk is contained in the container main body 11, (3) preventing the milk contained in the container main body 11 from leaking out even when the container main body 11 is tilted at the time of drinking, and (4) allowing the user to drink the milk easily even when the pressure within the container main body 11 becomes negative.

As shown in FIG. 3, the ventilation hole 18 and ventilation valve 17 of the beverage container 10 of the present embodiment are integrally formed in the ventilation member 16 and mounted in the base upright part 14.

Therefore, since the ventilation hole 18 serving as an opening and the ventilation valve 17 can be disposed in a single part, a simple configuration can be achieved and the number of parts can be reduced.

Consequently, the ventilation member 16 can be assembled easily and securely. As a result, it is possible to significantly reduce the problems associated with leakage of the milk from the base upright part 14 that is caused by inadequate assembly of the ventilation hole 18 and ventilation valve 17.

Note that, because the diameter of the ventilation valve 17 is larger than that of the ventilation hole 18 as shown in FIG. 3(*b*), it is possible to prevent the ventilation valve 17 and the ventilation hole 18 from being mounted the other way around by the user.

Moreover, even when the user needs to remove the ventilation hole 18 and the ventilation valve 17 for cleaning etc, they can be detached as one unit, making the beverage container 10 very handy for the user.

Note that the portable sealing convex part 15*b* shown in FIG. 2 and the like is an example of the portable sealing part for bringing the ventilation hole 18 and the ventilation valve 17 into the closed state when the hood 15 is in the portable state shown in FIG. 5, while the drinking sealing convex part 15*a* is an example of the drinking sealing part for bringing the ventilation hole 18 into the closed state and the ventilation valve 17 into the ventilation state when the hood 15 is in the drinking state shown in FIG. 2.

The air circulating part 15*c* is an example of the air circulating part for bringing the ventilation hole 18 and the ventilation valve 17 into the ventilation state when the hood 15 is in the operating state shown in FIG. 4.

The drinking sealing convex part 15*a*, portable sealing convex part 15*b* and air circulating part 15*c* are successively formed in the hood 15, as described above. Therefore, the ventilation hole 18 and/or the ventilation valve 17 can be brought into the closed state or the ventilation state according to need as described above, by moving the hood 15 in the direction of the arrow R shown in FIG. 2.

In this manner, the portable sealing convex part 15*b* can cover both the ventilation hole 18 and ventilation valve 17 by opening the closing the ventilation hole 18 and ventilation valve 17 by means of the drinking sealing convex part 15*a* or the portable sealing convex part 15*b* in accordance with the usage state and, at this moment, by forming the portable sealing convex part 15*b* wider than the drinking sealing convex part 15*a*. Moreover, the drinking sealing convex part 15*a* is configured to close the ventilation hole 18.

As a result, because the configuration can be made simple, not only is it possible to reduce the production cost but also it is possible to provide a beverage container 10 having excellent operability and capable of reliably exerting the above-mentioned function.

Moreover, in the present embodiment, as shown in FIG. 5 and others, the straw 20 can be housed between the hood 15 and the base member 12 or exposed by moving the hood 15. Therefore, not only is it possible for the user to expose the straw 20 by moving the hood 15, but also moving the hood 15 prevents leakage of the milk and allows the user to drink the milk easily, which makes the beverage container 10 handy.

(Second Embodiment)

Figure 6:
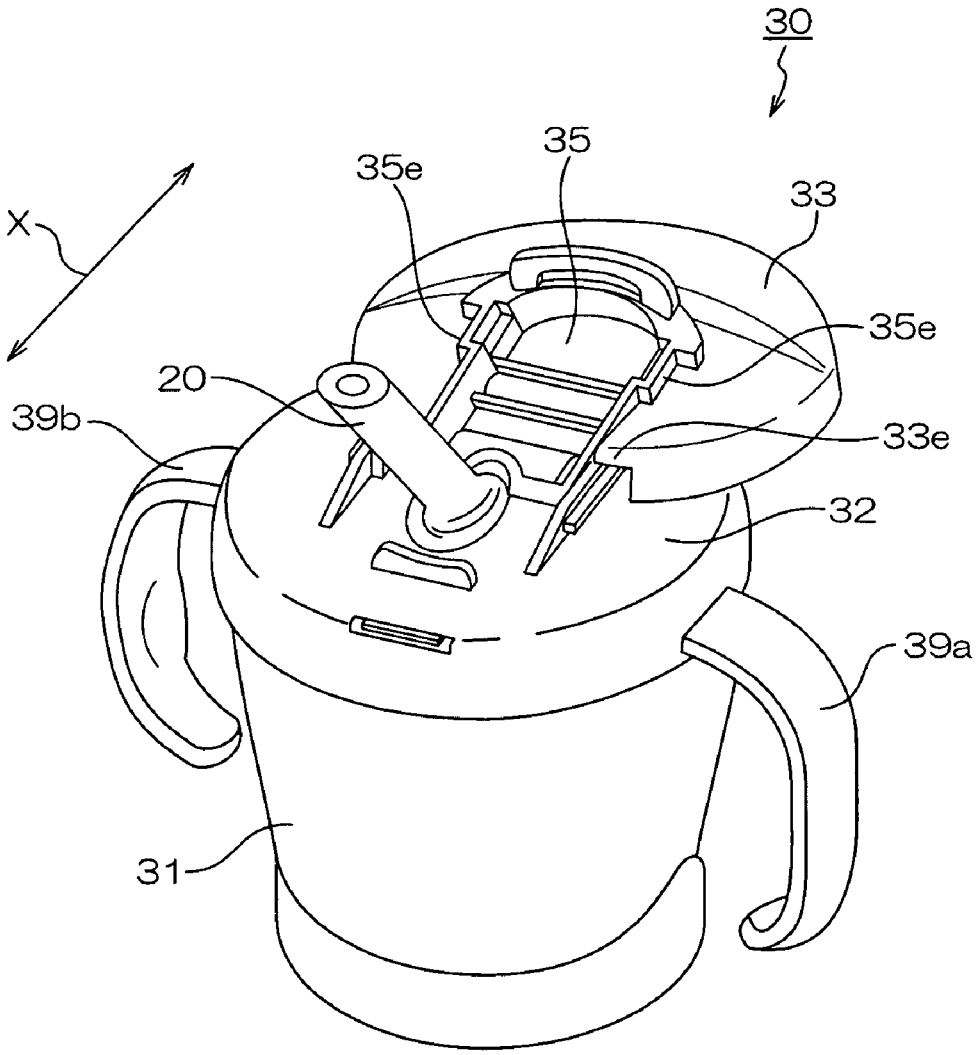
FIG. 6 is a schematic perspective diagram showing a beverage container according to a second embodiment of the present invention.

FIG. 6 is a schematic perspective diagram showing a beverage container 30 according to a second embodiment of the present invention. The beverage container 30 according to this embodiment has the same configurations as the beverage container 10 of the first embodiment. Therefore, the descriptions of the same configurations etc. are omitted and only the differences between these beverage containers are described hereinafter.

As shown in FIG. 6, the beverage container 30 has a container main body 31 for containing a beverage, such as milk, and a base member 32 is disposed to cover an opening provided in the upper part of the container main body 31. The straw 20 through which the user can drink the milk contained in the container main body 31 is disposed in the base member 32.

A hood 35, for example, which is a hood member that houses or exposes the straw 20 as described hereinafter, is disposed in the base member 32.

The base member 32 also has disposed therein a slider 33, which is, for example, regulating means for regulating a movement of the hood 35. This slider 33 is configured to move on the base member 32 along a surface of the base member 32.

In addition, two handles 39*a*, 39*b* are disposed on each side of the base member 32 so as to project along the container main body 31.

Figure 7:
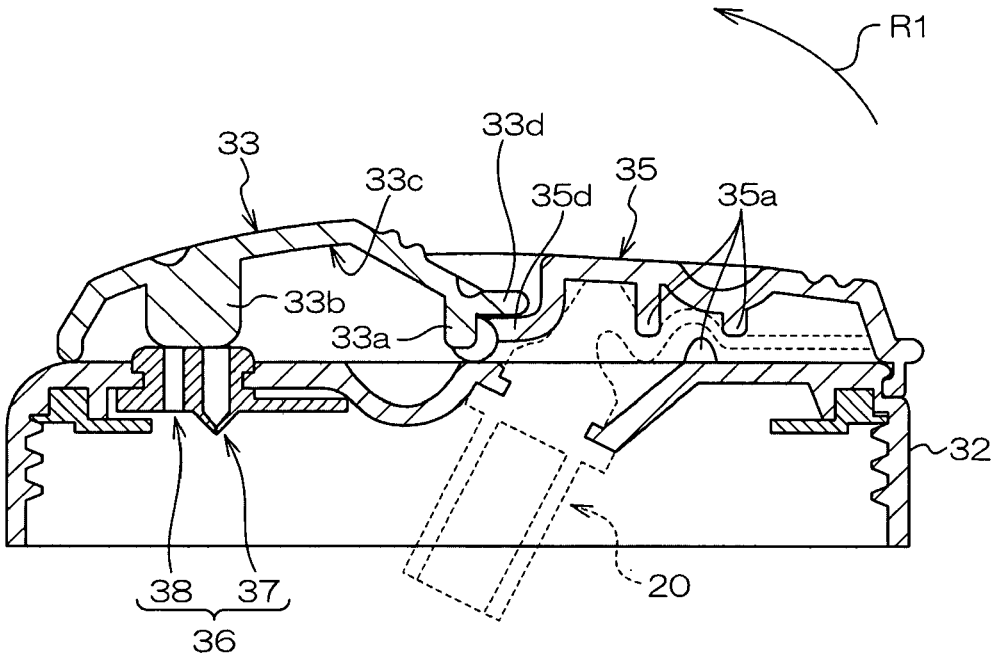
FIG. 7 is a schematic end view showing an operational state etc. of a slider, hood, straw etc. of FIG. 6.
Figure 8:
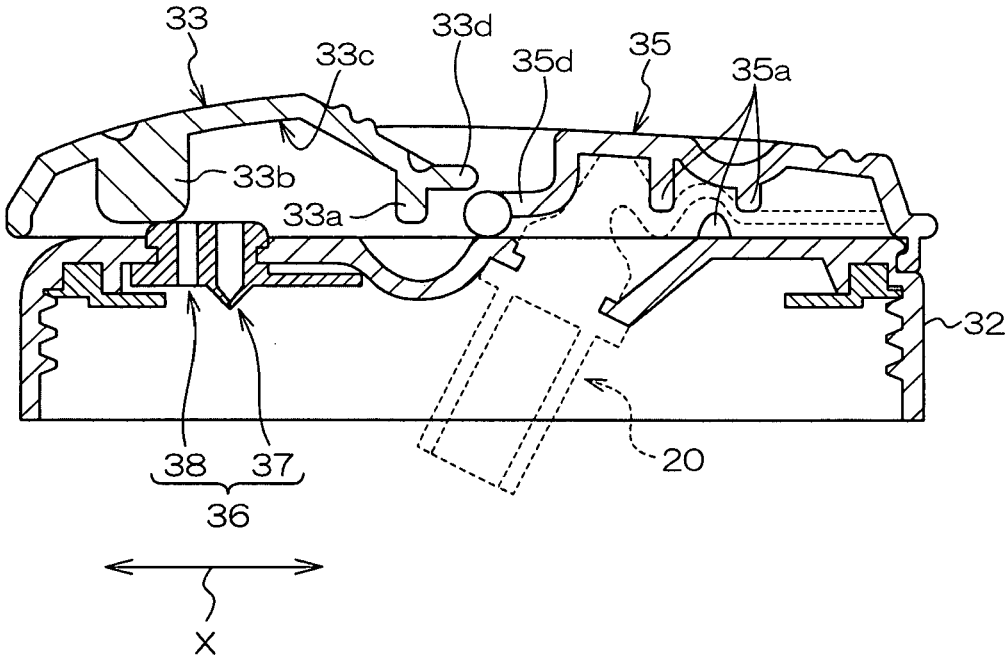
FIG. 8 is another schematic end view showing the operational state etc. of the slider, hood, straw etc. of FIG. 6.
Figure 9:
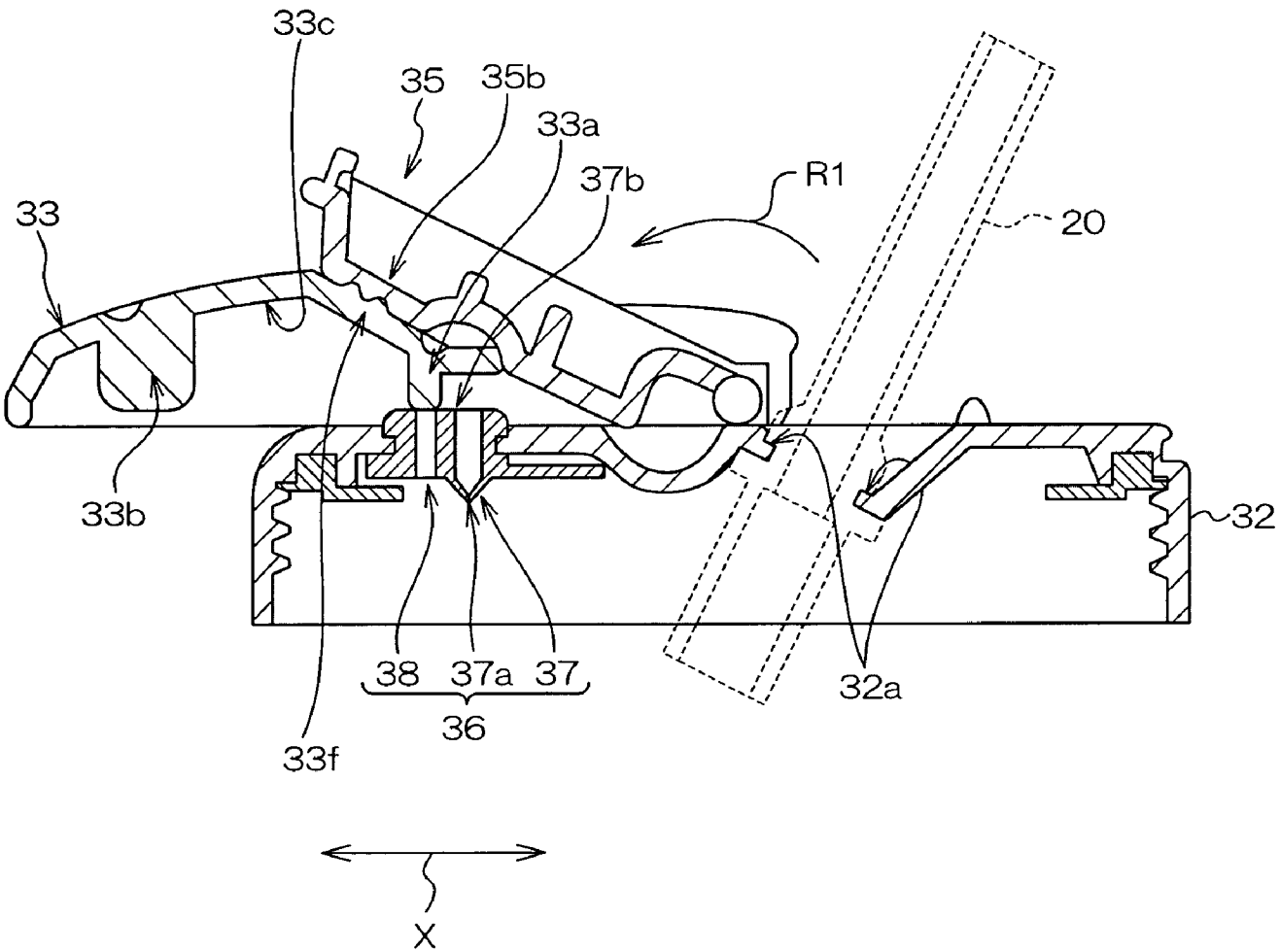
FIG. 9 is another schematic end view showing the operational state etc. of the slider, hood, straw etc. of FIG. 6.

FIG. 7, FIG. 8 and FIG. 9 are schematic end views each showing an operational state etc. of the slider 33 shown in FIG. 6 and the hood 35 and straw 20. Hereinafter, FIG. 9 is used to explain the configurations etc. of the base member 32, the slider 33 and the hood 35.

First, as shown in FIG. 9, the base member 32 has formed thereon a straw hole 32*a* to which the straw 20 is fitted. Therefore, the straw hole 32*a* is sealed by mounting the straw 20 into the straw hole 32*a* so that the milk contained in the container main body 31 does not leak from the straw hole 32*a*.

Next, a ventilation member 36 is disposed in the base member 32 as shown in FIG. 9. The ventilation member 36 has formed therein a ventilation hole 38 (same as the ventilation hole 18 of the first embodiment) and a ventilation valve 37 (same as the ventilation valve 17 of the first embodiment), as with the first embodiment described above.

Moreover, as shown in FIG. 9, a drinking sealing convex part 33*a* (same as the drinking sealing convex part 15*a* of the first embodiment), a portable sealing convex part 33*b* (same as the portable sealing convex part 15*b* of the first embodiment), and an air circulating part 33*c* (same as the air circulating part 15*c* of the first embodiment) are successively formed on the inside of the slider 33 (the base member 32 side).

Specifically, the drinking sealing convex part 33*a*, the portable sealing convex part 33*b* and the air circulating part 33*c* of the slider 33 serving as the means for regulating the movement of the hood 35 are the examples of the ventilation open/close means.

The operations etc. of the slider 33, the base member 32, the hood 35 and the straw 20 that are configured as above are described with reference to FIG. 7 to FIG. 9.

In the configuration of the portable beverage container according to the present embodiment, warm milk or the like is contained in the container main body 11. FIG. 7 is a schematic end view showing a portable state (same as the portable state described in the first embodiment).

As shown in FIG. 7, the straw 20 is covered by the hood 35 and bent by a straw sealing convex part 35*a* formed in a projecting manner on the hood 35. Because the opening of the straw 20 is in the closed state, the milk contained in the container main body 31 does not leak from the leading end of the straw 20 even when the beverage container 30 is tilted in the portable state.

Moreover, the hood 35 has a base end abutting part 35*d* at its based end side, and this base end abutting part 35*d* is brought into abutment against a based end side hood stopper 33*d* provided in the slider 33. Furthermore, the hood 35 has a leading end abutting part 35*e* at its leading end side, and this leading end abutting part 35*e* is brought into abutment against abase end side hood stopper 33*e* of the slider 33. In this manner, the based end abutting part 35*d* and the leading end abutting part 35*e* of the hood 35 are brought into abutment against the base end side hood stopper 33*d* and the leading end side hood stopper 33*e* of the slider 33, respectively, whereby the rotation of the hood 35 is regulated. Because the hood 35 is pressed against the base member 32, the hood 35 is prevented from being opened accidentally in the portable state (in the direction of the arrow R1 in FIG. 7), so that the milk does not leak from the leading end of the straw 20.

In addition, in the portable state the portable sealing convex part 33*b* of the slider 33 comes into abutment to cover both the ventilation hole 38 and the ventilation valve 37 and brings them into the closed state. Accordingly, even when the beverage container 30 is accidentally disposed the other around in a bag or the like in the portable state, the milk contained in the container main body 31 does not leak out, as with the first embodiment.

FIG. 8 corresponds to the operating state of the first embodiment. Specifically, when the slider 33 moves to the left in the direction of the arrow X shown in FIG. 8, the hood stopper 33*d* separates from the hood 35, the portable sealing convex part 33*b* also moves to the left in the drawing, and the ventilation state where nothing abuts against the ventilation hole 38 and the ventilation valve 37 is obtained.

At this moment, because the opening of the straw 20 is in the closed state due to the closed hood 35, the warm milk disposed in the container main body 31 makes the pressure within the container main body 31 positive in relation to the outside pressure. However, because the ventilation hole 38 is in the ventilation state, the pressure within the container main body 31 is regulated to be discharged and reduced to the atmospheric pressure.

FIG. 9 corresponds to the drinking state of the first embodiment. Specifically, when the hood 35 is rotated in the direction of the arrow R1 to open it after the slider 33 is further moved to the left and disposed to the position for opening the hood 35, the straw 20 is recovered so that the user can drink the milk through the straw 20. At this moment, when the pressure within the container main body 31 remains positive, the milk might squirt out of the leading end of the straw 20. In the present embodiment, however, as with the first embodiment, the milk is prevented from squirting out of the straw 20 because the ventilation hole 38 functions reduce the pressure from the positive pressure to the atmospheric pressure.

In the drinking state, the drinking sealing convex part 33*a* of the slider 33 brings the ventilation hole 38 into the closed state, as shown in FIG. 9. Therefore, similarly to the first embodiment, even when the user places the straw 20 in the mouth to drink the milk by largely tilting the beverage container 30 or even when the user tosses the beverage container 30, the milk contained in the container main body 31 does not leak from the ventilation hole 38 or the straw 20.

Moreover, as with the first embodiment, the drinking state is the ventilation state where nothing comes into abutment against an opening surface 37*b* of the ventilation valve 38 (see FIG. 9). Therefore, air is introduced from the ventilation valve 38 even when the user drinks the milk through the straw 20 and consequently negative pressure is generated in the container main body 31 due to the reduced content. As a result, the pressure within the container main body 31 promptly returns to the atmospheric pressure so that the user can drink the milk easily.

In the present embodiment described above, unlike the first embodiment, the ventilation hole 38 and the ventilation valve 37 can be brought into the closed state or the ventilation state by not the movement of the hood 35 itself but the movement of the slider 33 serving as the regulating means for regulating the movement of the hood 35. Therefore, the ventilation hole 38 and the like opened and closed without moving the hood 35.

Moreover, as shown in FIG. 9, a slider side concave/convex part 33*f* is formed on the surface of the slider 33, and a hood side concave/convex part 35*b* is formed on the hood 35 abutting against the slider side concave/convex part 33*f*, whereby the movement of the slider 33 is regulated by the hood 35 in the drinking state.

Therefore, when the hood 35 is opened the hood side concave/convex part 35*b* comes into abutment against the slider side concave/convex part 33*f*, whereby the position of the slider 33 in relation to the base member 32 can be determined accurately. Particularly, the ventilation hole 38 can be prevented from accidentally being brought into the ventilation state when the slider 33 moves in the direction of closing the hood 35 (right direction in FIG. 9) at the time of drinking.

(Third Embodiment)

Figure 10:
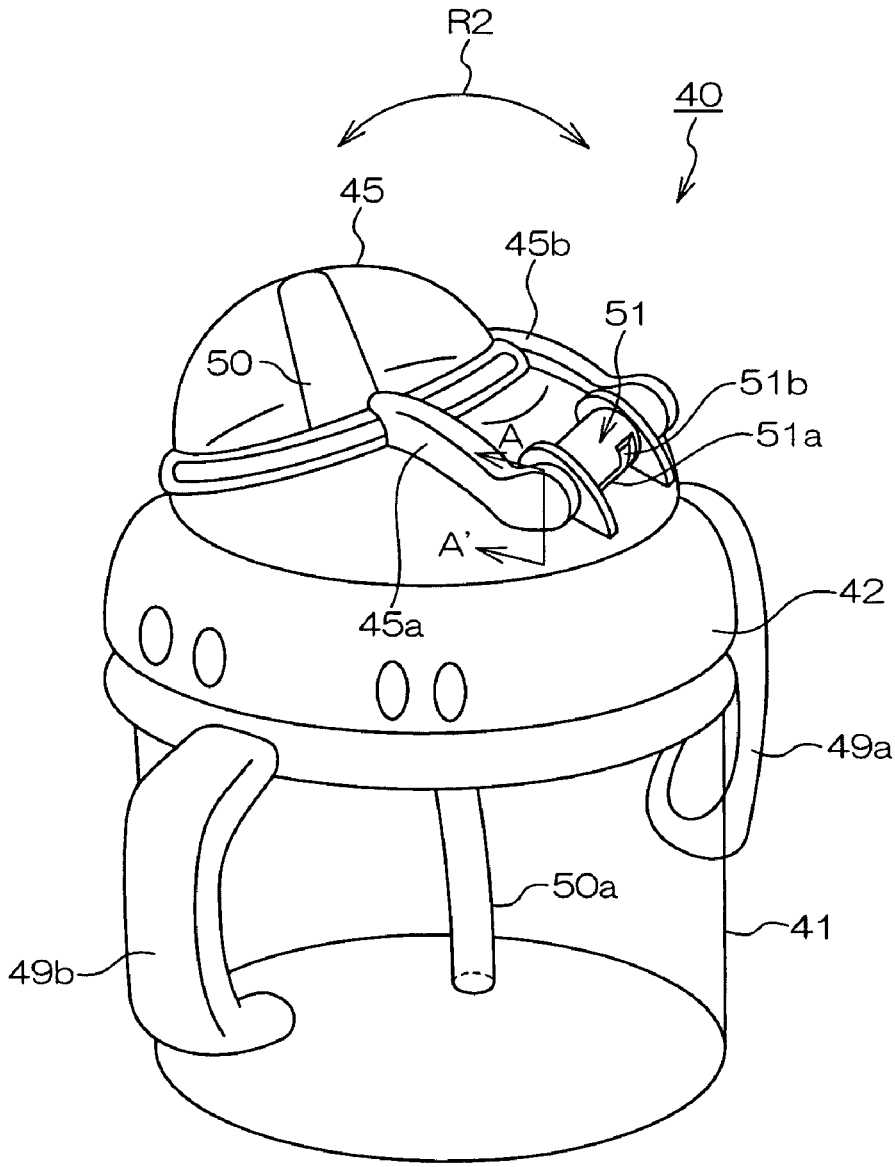
FIG. 10 is a schematic perspective diagram showing a beverage container according to a third embodiment of the present invention.

FIG. 10 is a schematic perspective diagram showing a beverage container 40 according to the third embodiment of the present invention. Because the beverage container 40 according to this embodiment has the same configuration as the beverage container 10 of the first embodiment, the descriptions of the same configurations etc. are omitted and only the differences between these beverage containers are described hereinafter.

The beverage container 40 has a container main body 41 for containing a beverage such as milk, and a base member 42 is disposed to cover an opening provided in the upper part of the container main body 41.

Two handles 49*a*, 49*b* are disposed on each side of the base member 42 along the container main body 41.

Also, a drinking spout 50 and a straw 50*a* are disposed in the base member 42. A hood 45 is disposed in the base member 42 to cover the drinking spout 50, wherein an inner surface of the hood 45 covers and closes a leading end of the straw 50. This hood 45 has two arms 45*a*, 45*b*, and these arms 45*a*, 45*b* are connected to a rotation axis 51.

Specifically, rotation of the rotation axis 51 shown in FIG. 10 allows the arms 45*a*, 45*b* and the hood 45 to rotate in the direction of the arrow R2 shown in FIG. 10.

In other words, in order to bring the beverage container 40 into the portable state (same as the portable state described in the first embodiment), the hood 45 is closed as shown in FIG. 10, to cover the drinking spout 50. On the other hand, in order to bring the beverage container 40 into the drinking state (same as the drinking state described in the first embodiment), the hood 45 needs to be opened widely along the direction of the arrow R2 to expose the drinking spout 50.

In addition, a moving state in which the hood 45 is disposed in the intermediate position between the portable state and the drinking state corresponds to the operating state (same as the operating state described in the first embodiment).

Figure 11:
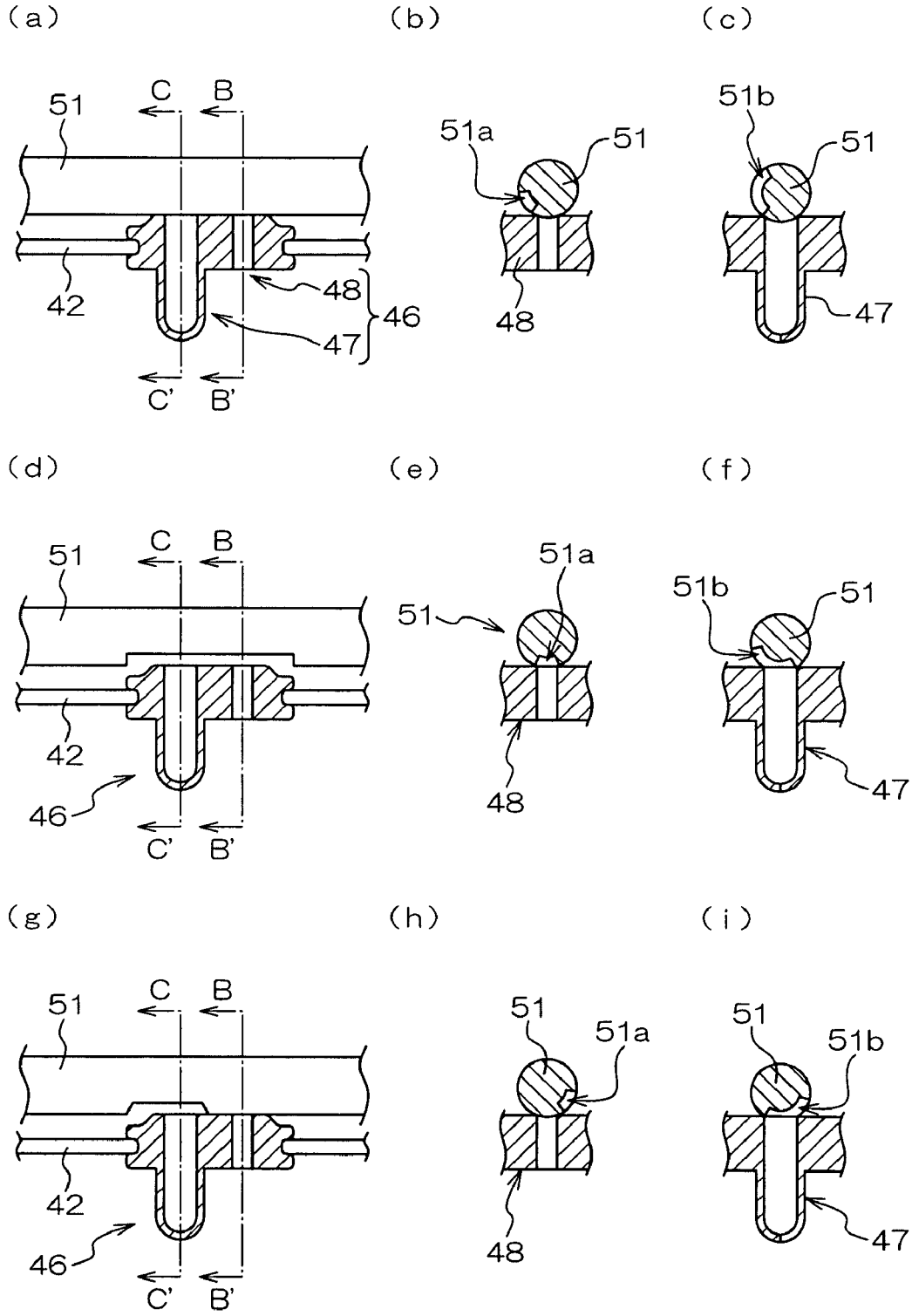
FIG. 11(*a*) is a schematic end view taken along the line A-A' of FIG. 10.

FIG. 11(*a*) is a schematic end view taken along the line A-A' of FIG. 10. As shown in FIG. 11(*a*), a ventilation member 46 same as the one described in the first embodiment is disposed in the base member 42 immediately below the rotation axis 51. In the ventilation member 46, a ventilation hole 48 corresponding to the ventilation hole 18 of the first embodiment and a ventilation valve 47 corresponding to the ventilation valve 17 of the first embodiment are integrally formed.

Specifically, while the ventilation valve 17 and the ventilation hole 18 of the ventilation member 46 are disposed in the vertical direction such as to approach/separate from the straw 20 in the other embodiments, in the present embodiment the ventilation valve 47 and the ventilation hole 48 are disposed so as to be equally spaced from the straw 50 in the horizontal direction.

FIG. 11(*b*) is a schematic end view taken along the line B-B' of FIG. 11(*a*). As shown in FIG. 11(*b*), a ventilation hole ventilation concave part 51*a* for bringing the ventilation hole 48 into the ventilation state is formed on the rotation axis 51. Therefore, when a part of the rotation axis 51 other than the ventilation hole ventilation concave part 51*a* comes into abutment against the ventilation hole 48, the ventilation hole 48 is brought into the closed state.

Specifically, the ventilation hole ventilation concave part 51*a* corresponds to the air circulating part 15*c* of the first embodiment, while the part of the rotation axis 51 other than the ventilation hole ventilation concave part 51*a* corresponds to the portable sealing convex part 15*b* and the drinking sealing convex part 15*a* of the first embodiment.

FIG. 11(*c*) is a schematic end view taken along the line C-C' of FIG. 11(*a*). As shown in FIG. 11(*c*), a ventilation valve ventilation concave part 51*b* for bringing the ventilation valve 47 into the ventilation state is formed on the rotation axis 51. Therefore, when a part of the rotation axis 51 other than the ventilation valve ventilation concave part 51*b* comes into abutment against the ventilation valve 47, the ventilation valve 47 is brought into the closed state.

Specifically, the ventilation valve ventilation concave part 51*b* corresponds to the air circulating part 15*c* of the first embodiment, while the part of the rotation axis 51 other than the ventilation valve ventilation concave part 51*b* corresponds to the portable sealing convex part 15*b* of the first embodiment.

Note that, as shown in FIG. 10, the ventilation hole ventilation concave part 51*a* and the ventilation valve ventilation concave part 51*b* are connected to each other via the rotation axis 51 and have the concave parts of different lengths in the length around the rotation axis 51.

FIG. 11(*d*) is a schematic end view showing the relationship between the rotation axis 51 and the ventilation member 46, the relationship being obtained when the hood 45 shown in FIG. 10 is disposed in the abovementioned operating state. FIG. 11(*e*) is a schematic end view taken along the line B-B' of FIG. 11(*d*). FIG. 11(*f*) is a schematic end view taken along the line C-C' of FIG. 11(*d*).

FIG. 11(*g*) is a schematic end view showing the relationship between the rotation axis 51 and the ventilation member 46, the relationship being obtained when the hood 45 shown in FIG. 10 is disposed in the drinking state. FIG. 11(*h*) is a schematic end view taken along the line B-B' of FIG. 11(*g*). FIG. 11(*i*) is a schematic end view taken along the line C-C' of FIG. 11(*g*).

The operations of the beverage container 40 in the portable state in which the hood 45 is closed, the operating state in which the hood 45 is about to be opened, and the drinking state in which the user opens the hood 45 to drink the milk through the drinking spout are now described with reference to FIG. 11(*a*) to FIG. 11(*i*).

First, in the portable state in which the hood 45 is closed as shown in FIG. 10 and the user can carry the beverage container 40, the rotation axis 51 and the ventilation member 46 are in the states shown in FIG. 11(*a*) to FIG. 11(*c*). Specifically, the ventilation hole 48 and ventilation valve 47 of the ventilation member 46 are in the closed state where they come into abutment against the rotation axis 51, whereby the milk contained in the container main body 41 does not leak from the ventilation hole 48 even when the user tilts the beverage container 40. Moreover, at this moment, the leading end of the straw 50 is also in the sealed state where it is closed by the hood 45.

Next, in the operating state where the operator attempts to open the hood 45, the ventilation hole 48 is in the ventilation state, as shown in FIG. 11(*d*) to FIG. 11(*f*). Specifically, the ventilation hole ventilation concave part 51*a* is disposed on the ventilation hole 48 as shown in FIG. 11(*e*) and is communicated to the outside via the ventilation valve ventilation concave part 51*b*. Therefore, even when the warm milk contained in the container main body 41 makes the pressure within the container main body 41 positive in relation to the outside pressure, the pressure is reduced to the atmospheric pressure by the ventilation hole 48. As a result, the milk contained in the container main body 41 can be prevented from squirting out from the drinking spout 50.

Next, in the drinking state where the hood 45 is opened, as shown in FIG. 11(*g*) to FIG. 11(*i*), the ventilation hole 48 is in the closed state where it comes into abutment against the rotation axis 51, while the ventilation valve 47 is in the ventilation state. Therefore, the milk contained in the container main body 41 does not leak from the ventilation hole 48 even when the user places the drinking spout 50 in the mouth and tilts the beverage container 40 to drink the milk.

Moreover, even when the user drinks the milk through the drinking spout 50 and, consequently, negative pressure is generated in the container main body 41 due to the reduced content, the ventilation valve 47 of the present embodiment can introduce air from the outside so that the generation of negative pressure can be prevented.

Therefore, the beverage container 40 from which the user can drink the milk easily can be achieved.

(Fourth Embodiment)

Figure 12:
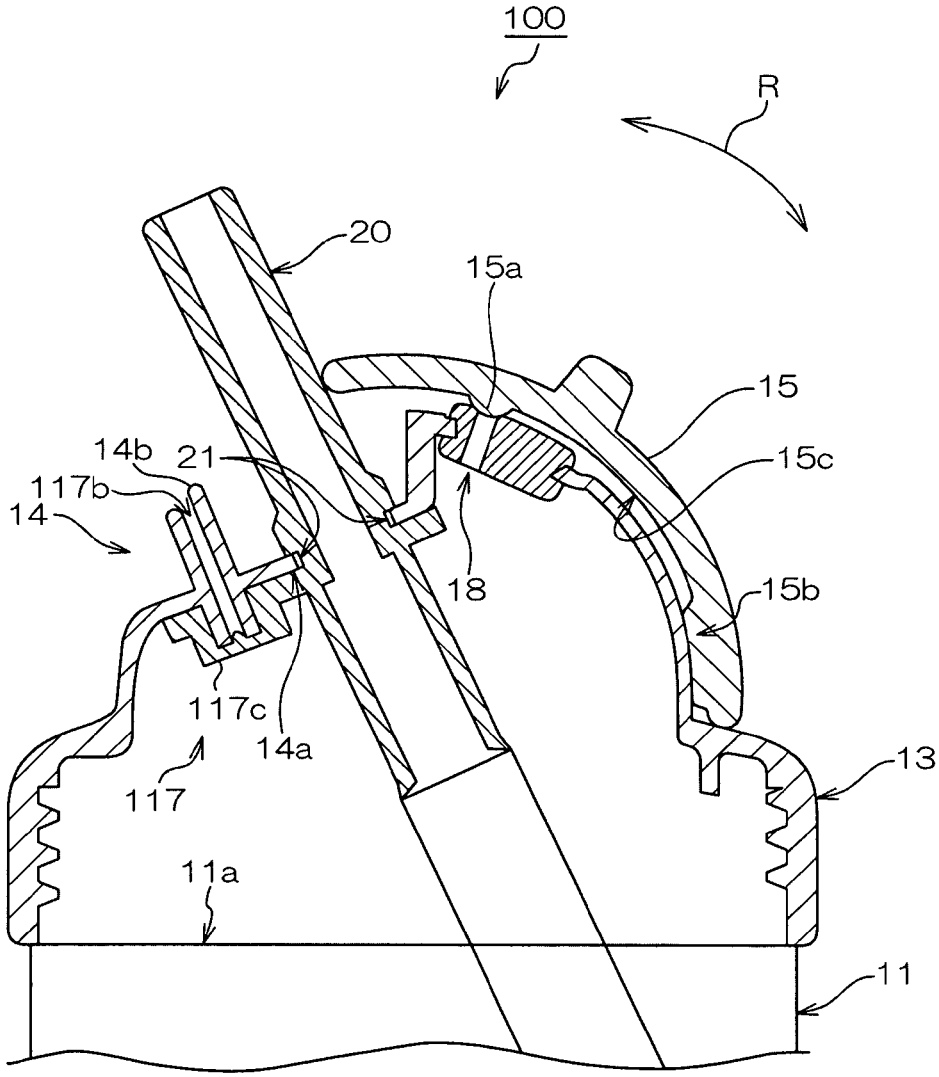
FIG. 12 is a schematic perspective diagram showing a beverage container according to a fourth embodiment of the present invention.

FIG. 12 is a schematic perspective diagram showing a beverage container 100 according to a fourth embodiment of the present invention. Because the beverage container 100 according to this embodiment has the same configuration as the beverage container 10 of the first embodiment, the descriptions of the same configurations etc. are omitted and only the differences between these beverage containers are described hereinafter.

Although the ventilation hole 18 and the ventilation valve 17 are integrally formed in the ventilation member 16 in the first embodiment, in the present embodiment the ventilation hole 18 and the ventilation valve 17 are formed separately, unlike the first embodiment, and also the structure of the ventilation valve of the present embodiment is different from that of the first embodiment. The ventilation valve of the present embodiment is referred to as a ventilation valve 117 hereinafter. The ventilation valve 117 is an example of the second ventilation means.

As shown in FIG. 12, the ventilation valve 117 has, for example, a ventilation opening 117*b*, which is a ventilation opening part for introducing air from the outside, and, for example, a closing member 117*c*, which is a ventilation closing part capable of changing the state of the ventilation opening 117*b* to the ventilation state or the closed state.

Figure 14:
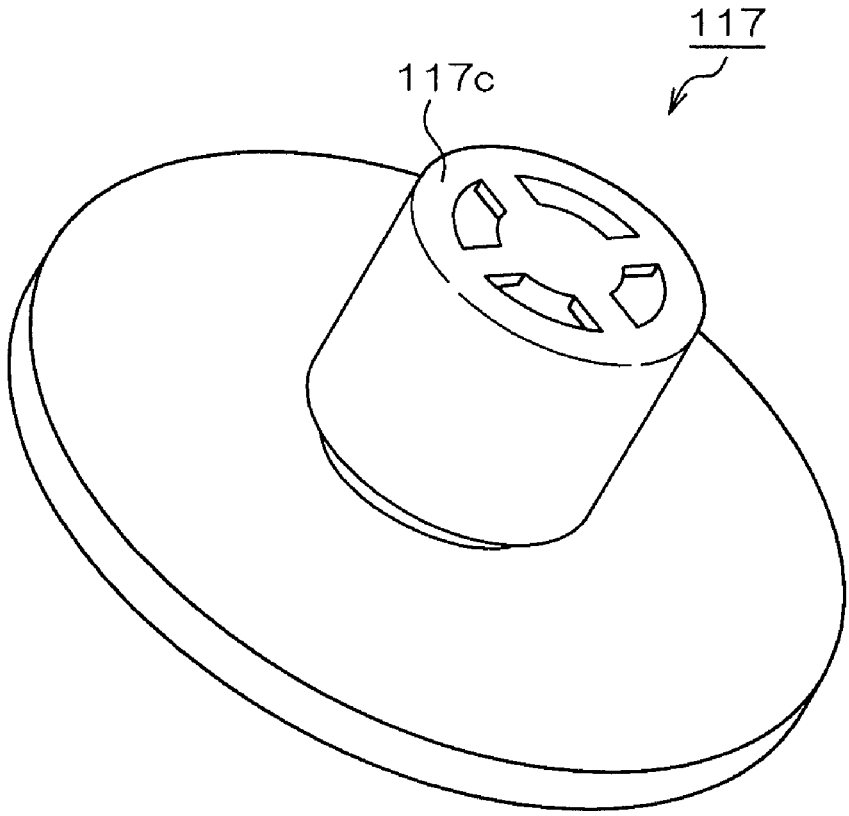
FIG. 14 is a schematic perspective diagram showing the entire configuration of the ventilation valve.
Figure 15:
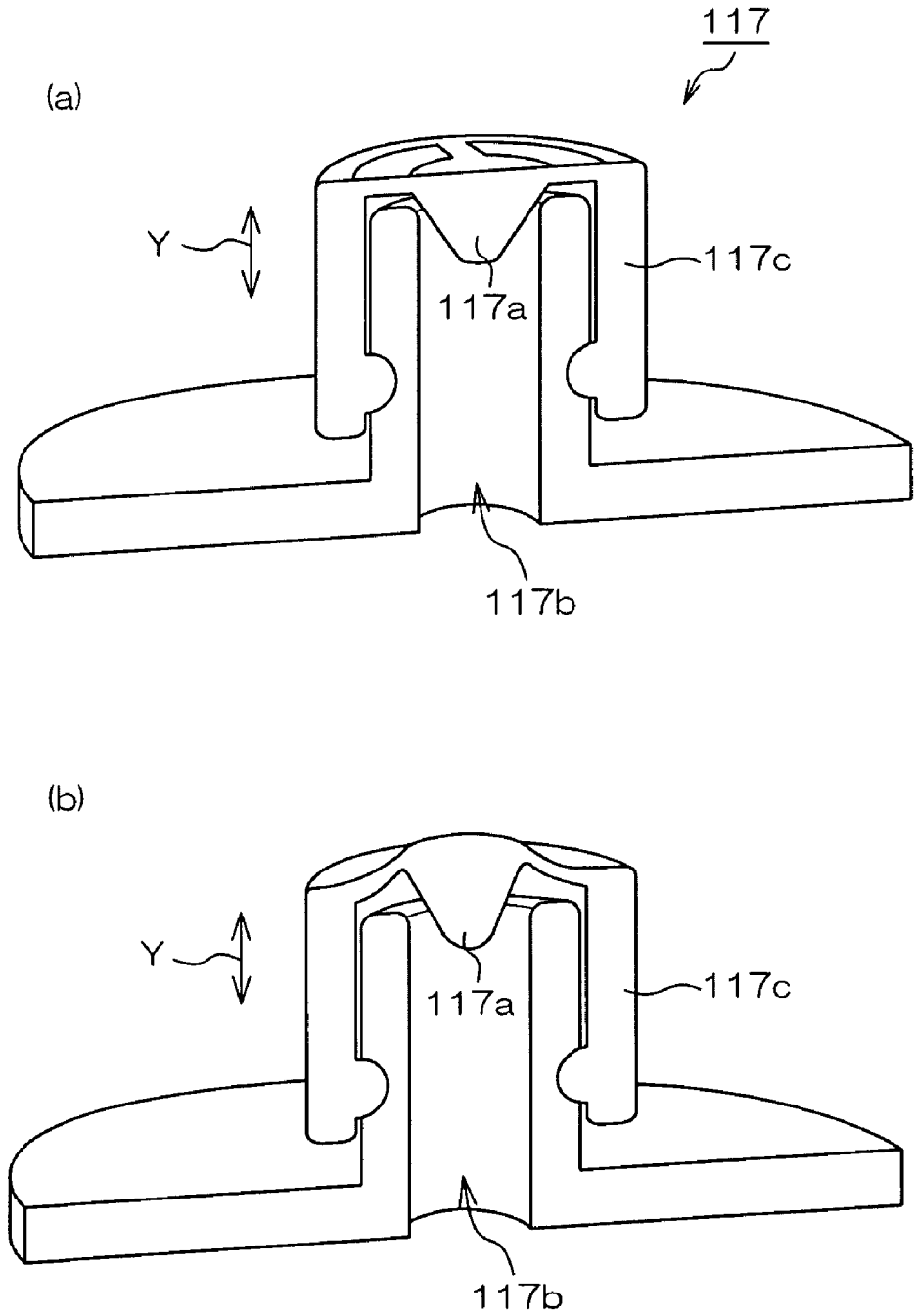
FIG. 15(*a*) is a schematic cross-sectional diagram showing a state in which a closing member closes a ventilation opening part.

FIG. 14 is a schematic perspective diagram showing the entire configuration of the ventilation valve 117 shown in FIG. 12. FIG. 15 is a schematic cross-sectional diagram showing an operational state of the ventilation valve 117. Specifically, FIG. 15(*a*) is a schematic cross-sectional diagram showing a state in which the closing member 117*c* closes the ventilation opening 117*b*, and FIG. 15(*b*) a schematic cross-sectional diagram showing a state in which the closing member 117*c* allows the air to pass through the ventilation opening 117*b*. As shown in FIG. 15(*a*) and FIG. 15(*b*), the closing member 117*c* is structured such as to change the state of the ventilation opening 117*b* to the closed state or the ventilation state by moving in the direction of the arrow Y shown in the diagram.

Specifically, as shown in FIG. 15, the closing member 117*c* has a closing convex part 117*a* with a convex cross-sectional shape. This sealing convex part 117*a* moves back and forth with respect to one end of the ventilation opening 117*b* to change the state of the ventilation opening 117*b* to the closed state or the ventilation state.

This movement (back and forth) of the closing member 117*c* in the direction of the arrow Y changes on the basis of the negative pressure within the container main body 11 shown in FIG. 12. The detail of this movement is described hereinafter.

Specifically, as shown in FIG. 12, in the drinking state in which the straw 20 projects from the beverage container 100 to allow the user to drink the liquid beverage contained in the container main body 11, the closing convex part 117*a* of the closing member 117*c* of the ventilation valve 117 enters a state in which the ventilation opening 117*b* is closed, that is, a state shown in FIG. 15(*a*).

For this reason, even when the user accidentally tosses the beverage container 100 and, as a result the milk contained in the container main body 11 as the liquid beverage flows toward the outside through the straw 20, air does not flow from the outside into the container main body 11. As a result, the negative pressure is not eliminated, preventing the milk from leaking from the straw 20.

However, when the negative pressure is not eliminated (canceled) as described above, the user cannot drink the milk easily when the user attempts to drink the milk through the straw 20.

Therefore, in the present embodiment, when the user places the straw 20 shown in FIG. 12 in the mouth and suctions it, the closing member 117*c* of the ventilation valve 117 starts moving as a result of the increased negative pressure, and changes the state shown in FIG. 15(*a*) to the state shown in FIG. 15(*b*).

Figure 13:
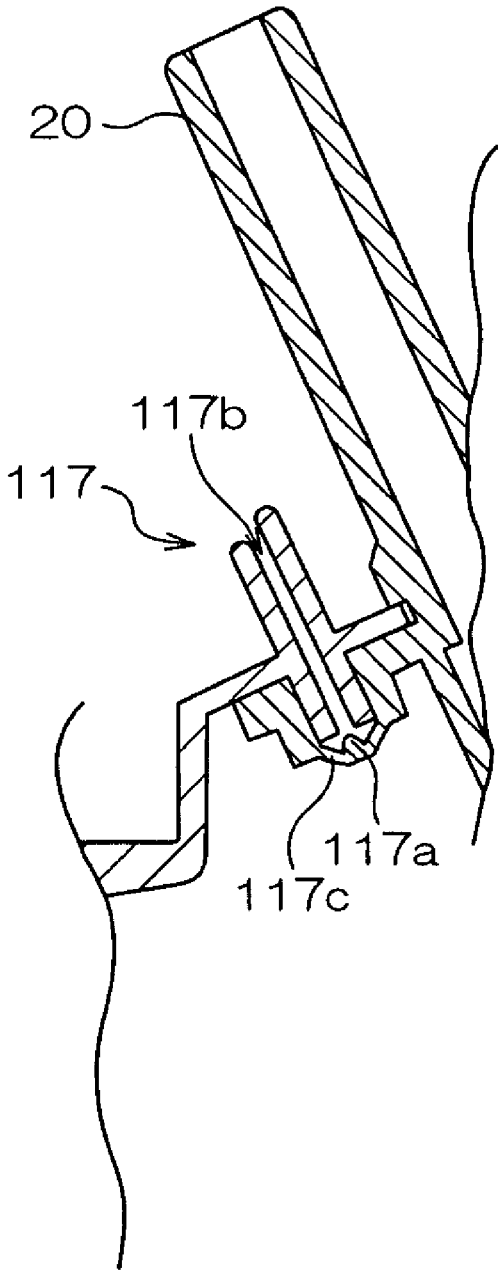
FIG. 13 is a schematic explanatory diagram showing a ventilation state of a ventilation valve.

FIG. 13 shows the state of FIG. 15(*b*). Specifically, FIG. 13 is a schematic explanatory diagram showing the ventilation state of the ventilation valve 117.

As shown in FIG. 13, when the closing member 117*c* moves toward the inside of the container main body 11 as a result of the increased negative pressure described above, the closing convex part 117*a* closing the ventilation opening 117*b* separates from the end part of the ventilation opening 117*b*, which brings the ventilation opening 117*b* into the ventilation state, whereby the air flows in from the outside.

As a result, the negative pressure within the container main body 11 is eliminated, and the user can smoothly drink the milk contained in the container main body 11.

As described above, in the present embodiment, even when the user accidentally tosses the beverage container 11 in the drinking state in which the hood 15 of the beverage container 100 is opened to expose the straw 20, the milk does not leak from the straw 20.

Moreover, when the negative pressure within the container main body 11 is increased as a result of the suction operation performed by the user to drink the milk through the straw 20 (an example of the state of the negative pressure which is increased as a result of the drinking action), the ventilation valve 117 starts to operate for the first time to change the closed state to the ventilation state, so that the user can smoothly suction the straw 20 when drinking the milk.

(Fifth Embodiment)

Figure 16:
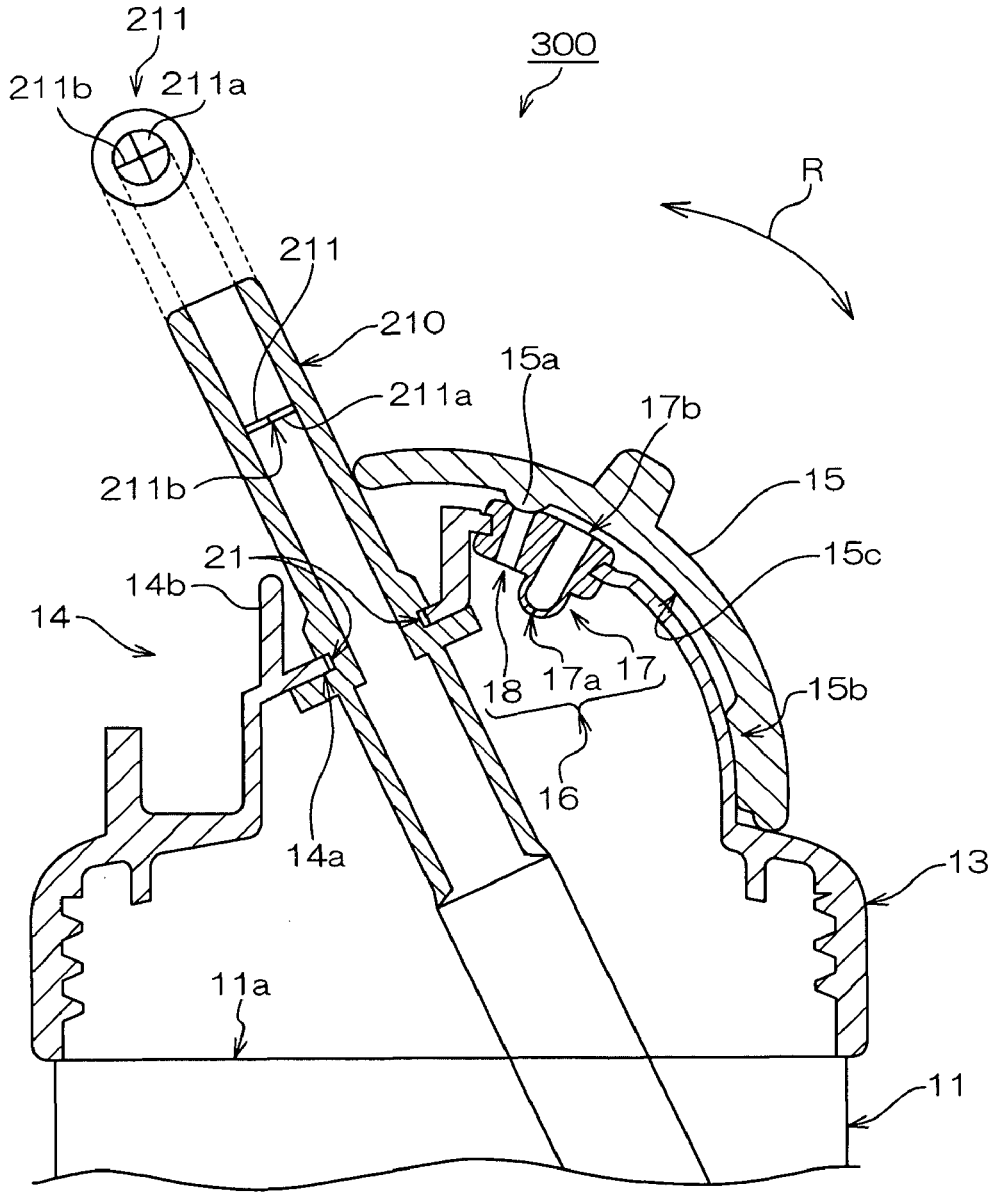
FIG. 16 is a schematic perspective diagram showing a beverage container according to a fifth embodiment of the present invention.

FIG. 16 is a schematic perspective diagram showing a beverage container 300 according to a fifth embodiment of the present invention. Because the beverage container 300 according to this embodiment has the same configuration as the beverage container 10 of the first embodiment, the descriptions of the same configurations etc. are omitted and only the differences between these beverage containers are described hereinafter.

In the present embodiment, unlike the embodiments described above, an open/close valve 211 is formed on the inside of a straw 210, as shown in FIG. 16. In this open/close valve 211, as shown in the diagram, not only a shielding part 211*a* for blocking the milk contained in the container main body 11 is formed, but also, for example, a slit 211*b* is formed as a cutout part in the shape of a cross.

This open/close valve 211 deforms when the user deforms the straw 210 with a hand or mouth or when the user suctions the straw 210. At this moment, the slit 211*b* is opened. In other words, the open/close valve 211 is configured in a deformable manner.

Figure 17:
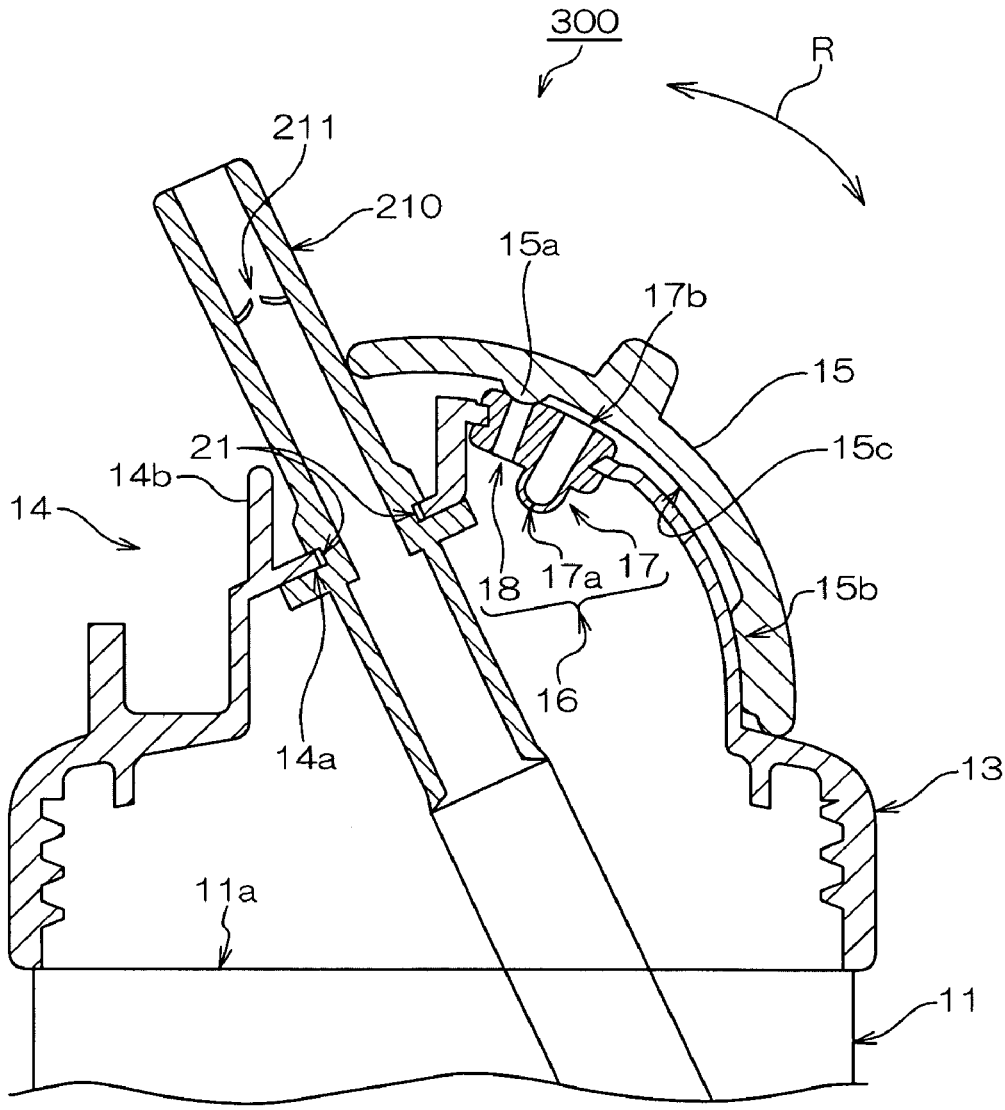
FIG. 17 is a schematic explanatory diagram showing a state in which a slit is opened.

FIG. 17 is a schematic explanatory diagram showing a state in which the slit 211*b* is opened. As shown in FIG. 17, the milk contained in the container main body 11 flows from the straw 210 to the outside by opening the slit 211*b*.

This embodiment achieves the following operations due to the above configurations. Specifically, even when the user accidentally tosses the beverage container 300 in the drinking state shown in FIG. 16 and, consequently, the milk flows out through the straw 210, the milk is blocked by the open/close valve 211 and thus prevented from leaking out.

However, when the user places the straw 210 in the mouth and drinks the milk, the straw 210 is deformed by the force of the mouth, or the slit 211*b* is opened as the user suctions the straw 210. Accordingly, the user can drink the milk smoothly.

More specifically, the open/close valve 211 can prevent leakage of the milk contained in the container main body 11 and allow the milk to flow out by means of the deformation of the straw 210.

Figure 18:
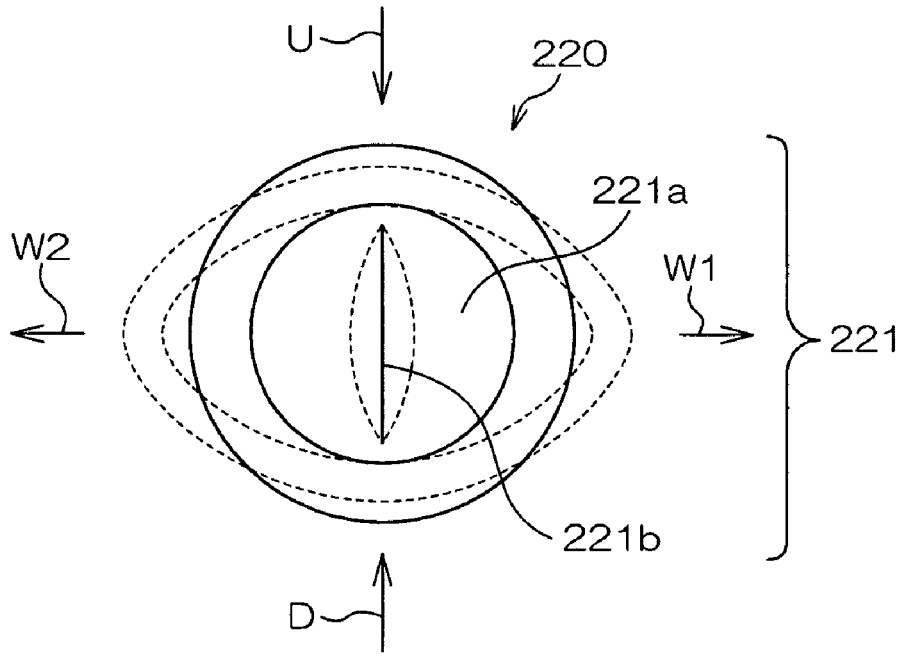
FIG. 18 is a schematic explanatory diagram showing a modification of the fifth embodiment.

Note in the present embodiment that the shape of the slit 211*b* is not limited to the shape of a cross, and therefore it may be in the shape of a straight line. FIG. 18 is a schematic explanatory diagram showing a modification of the fifth embodiment.

As shown in FIG. 18, in this modification an open/close valve 221 is formed on the inside of a straw 220, and a slit 221*b* of the open/close valve 221 is formed in the shape of a straight line in the vertical direction in the drawing.

Therefore, when the user places the straw 220 in the mouth to drink the milk and then flattens the straw 220 in the directions of the arrows U and D shown in the drawing (directions toward the inside of the straw 220), the straw 220 deforms to spread in the directions of W1 and W2 shown in the drawing (directions toward the outside of the straw 220) (the section shown by the dashed-lines).

At this moment, the slit 221*b* also opens in the directions of the arrows W1 and W2 as shown by the dashed lines in the drawing, whereby the milk can flow out.

The present invention is not limited to the above embodiments. For example, instead of configuring the regulating means with the slider 33, the movement regulating means may be operated by a lever that rotates around the axis along the surface of the base member 13, or may be configured as a button that approaches/separates from the base member 13, to regulate the movement of the hood 35. Furthermore, instead of forming the ventilation open/close means with a hood, a concave part or a convex part provided directly on the movement regulating means, a movable member that moves in conjunction with the movement of the hood or the movement regulating means may be disposed between the hood or the movement regulating means and the ventilation member to open/close the ventilation hole and the ventilation valve. Moreover, the ventilation valve may not be a U-shaped or V-shaped valve but may be a check valve that is made of a movable member moving in accordance with pressure variation. In addition, although the handles are disposed on each side of the base member in each of the embodiments, a so-called one-handled cup having a handle on one side only or a beverage container with no handle may be configured. Any combination of the embodiments may be possible.

The invention claimed is:

1. A beverage container, comprising:

a container main body having a container opening part for pouring a liquid beverage therein;

a base member which covers the container opening part and in which a drinking spout is disposed; and a cap body configured to openably/closably cover an upper part of the base member, wherein the base member has:

a first ventilation structure configured to regulate a pressure variation in the container main body and a second ventilation structure configured to introduce air from outside when pressure within the container main body enters a negative pressure state in relation to outside pressure, and configured to prevent the liquid beverage contained in the container main body from leaking, the first ventilation structure and the second ventilation structure together forming a unit separate from the drinking spout and providing a separate path for introducing air and regulating pressure variation in the container main body; wherein the cap body has formed thereon a ventilation open/close structure configured to change a state of the first ventilation structure to at least one of a ventilation state and a closed state, the ventilation open/close structure is configured to sealably close the first ventilation structure when the cap body is in a portable state in which the cap body is disposed to cover the drinking spout so that a user can carry the beverage container and when the cap body is in a drinking state in which the cap body is disposed to expose the drinking spout so that the user can use the drinking spout, and the ventilation open/close structure is configured to bring the first ventilation structure into the ventilation state when the cap body is in an operating state in which the cap body is disposed in an intermediate position between the portable state and the drinking state.

2. The beverage container according to claim 1, wherein the first ventilation structure is a ventilation hole in the form of a through-hole, the second ventilation structure is a ventilation valve in the form of a check valve for allowing air to flow only into the container main body, and the ventilation hole and the ventilation valve are formed as an integrated ventilation member, and the ventilation member is disposed on the base member.

3. The beverage container according to claim 1, wherein the ventilation open/close structure has formed therein:

a portable sealing part for bringing the first ventilation structure and the second ventilation structure into the closed state when the cap body is in the portable state;

a drinking sealing part for bringing the first ventilation structure into the closed state and the second ventilation structure into the ventilation state when the cap body is in the drinking state; and an air circulating part for bringing the first ventilation structure into the ventilation state when the cap body is in the operating state.

4. The beverage container according to claim 1, wherein the cap body is configured to selectively house and expose the drinking spout disposed in the base member, by changing a position of the cap body relative to the base member.

5. The beverage container according to claim 1, wherein the cap body has a hood member configured for selectively housing and exposing the drinking spout, and a regulating structure configured to regulate movement of the hood member, and the ventilation open/close structure is formed in the regulating structure.

6. The beverage container according to claim 1, wherein the first ventilation structure is a ventilation hole in the form of a through-hole, and the second ventilation structure is configured to introduce air from the outside when the pressure within the container main body increases to the negative pressure state resulting from a drinking action of the user.

7. The beverage container according to claim 6, wherein the second ventilation structure has:

a ventilation opening part for introducing air from the outside; and a ventilation closing part capable of bringing the ventilation opening part into a closed state, and wherein when the negative pressure within the container main body increases to a negative pressure state resulting from the drinking action of the user, the ventilation closing part releases the closed state of the ventilation opening part to introduce air from the outside.

8. The beverage container according to claim 1, wherein the drinking spout has formed thereon an open/close valve capable of preventing leakage of the liquid beverage contained in the container main body and of flowing the liquid beverage out by means of deformation of the drinking spout.

9. The beverage container according to claim 8, wherein the open/close valve is a shielding part for blocking the liquid beverage contained in the drinking spout and a cutout part that is formed in the shielding part in a deformable manner.

10. The beverage container according to claim 1, wherein the first ventilation structure is a ventilation hole in the form of a through-hole, the second ventilation structure is a ventilation valve in the form of a check valve configured to allow air to flow only into the container main body, and the ventilation hole and the ventilation valve are formed as an integrated ventilation member, and the ventilation member is disposed on the base member.

11. The beverage container according to claim 1, wherein the ventilation open/close structure has formed therein:

a portable sealing part configured to bring the first ventilation structure and the second ventilation structure into the closed state when the cap body is in the portable state;

a drinking sealing part configured to bring the first ventilation structure into the closed state and the second ventilation structure into the ventilation state when the cap body is in the drinking state; and an air circulating part configured to bring the first ventilation structure into the ventilation state when the cap body is in the operating state.

12. The beverage container according to claim 2, wherein the ventilation open/close structure has formed therein:

a portable sealing part configured to bring the first ventilation structure and the second ventilation structure into the closed state when the cap body is in the portable state;

a drinking sealing part configured to bring the first ventilation structure into the closed state and the second ventilation structure into the ventilation state when the cap body is in the drinking state; and an air circulating part configured to bring the first ventilation structure into the ventilation state when the cap body is in the operating state.

13. The beverage container according to claim 1, wherein the cap body has a hood member for selectively housing and exposing the drinking spout, and a regulating structure configured to regulate movement of the hood member, and the ventilation open/close structure is formed in the regulating structure.

14. The beverage container according to claim 2, wherein the cap body has a hood member for selectively housing and exposing the drinking spout, and a regulating structure configured to regulate movement of the hood member, and the ventilation open/close structure is formed in the regulating structure.

15. The beverage container according to claim 3, wherein the cap body has a hood member for selectively housing and exposing the drinking spout, and a regulating structure configured to regulate movement of the hood member, and the ventilation open/close structure is formed in the regulating structure.

16. The beverage container according to claim 1, wherein the first ventilation structure is a ventilation hole in the form of a through-hole, and the second ventilation structure introduces air from the outside when the negative pressure within the container main body increases to a negative pressure state resulting from a drinking action of the user.

17. The beverage container according to claim 1, wherein the drinking spout has formed thereon an open/close valve configured to be deformable to an extent that prevents leakage of the liquid beverage contained in the container main body and that allows flowing the liquid beverage out due to deformation of the drinking spout.

18. The beverage container according to claim 2, wherein the drinking spout has formed thereon an open/close valve capable of preventing leakage of the liquid beverage contained in the container main body and of flowing the liquid beverage out by means of deformation of the drinking spout.

19. The beverage container according to claim 3, wherein the drinking spout has formed thereon an open/close valve capable of preventing leakage of the liquid beverage contained in the container main body and of flowing the liquid beverage out by means of deformation of the drinking spout.

* * * * *